US010729196B2

(12) United States Patent
Brisby

(10) Patent No.: US 10,729,196 B2
(45) Date of Patent: Aug. 4, 2020

(54) SHIRT HAVING RETAINER FOR ROLLED-UP SLEEVES

(71) Applicant: VF Jeanswear, L.P., Greensboro, NC (US)

(72) Inventor: Danny Brisby, Greensboro, NC (US)

(73) Assignee: VF Jeanswear L.P., Greensboro, NC (US)

( * ) Notice: Subject to any disclaimer, the term of this patent is extended or adjusted under 35 U.S.C. 154(b) by 120 days.

(21) Appl. No.: 16/009,960

(22) Filed: Jun. 15, 2018

(65) Prior Publication Data

US 2019/0380412 A1 Dec. 19, 2019

(51) Int. Cl.

| | |
|---|---|
| ***A41F 19/00*** | (2006.01) |
| ***A41B 1/08*** | (2006.01) |
| ***A44B 5/00*** | (2006.01) |
| ***A41D 27/10*** | (2006.01) |

(52) U.S. Cl.

CPC ..... *A41F 19/005* (2013.01); *A41B 1/08* (2013.01); *A41D 27/10* (2013.01); *A44B 5/00* (2013.01)

(58) Field of Classification Search

CPC ..... A41F 19/005; A44B 5/00; A41B 1/08; A41D 27/10

See application file for complete search history.

(56) References Cited

U.S. PATENT DOCUMENTS

| | | | | | |
|---|---|---|---|---|---|
| 811,662 | A * | 2/1906 | Puryear | A41D 1/06 | 2/269 |
| 1,085,399 | A * | 1/1914 | Bauer | A41D 1/06 | 2/269 |
| 1,116,307 | A | 11/1914 | Lynch | | |
| 1,470,471 | A * | 10/1923 | Peters | A41F 19/005 | 24/507 |
| 2,153,068 | A * | 4/1939 | Arden | A41F 19/005 | 2/269 |
| 2,187,447 | A * | 1/1940 | Chait | A41D 1/06 | 2/227 |
| 2,352,614 | A * | 7/1944 | Brown | A41D 27/10 | 2/269 |
| 2,626,396 | A * | 1/1953 | Kanin | A41D 27/10 | 2/269 |
| 2,675,554 | A * | 4/1954 | Gertz | A41D 19/0017 | 2/80 |
| 4,149,275 | A * | 4/1979 | Sanchez | A41D 1/06 | 2/269 |
| 4,200,938 | A * | 5/1980 | LeTourneau | A41D 1/06 | 2/269 |
| 5,404,592 | A | 4/1995 | Jackson | | |
| 5,692,239 | A | 12/1997 | Lewis | | |

(Continued)

*Primary Examiner* — Khaled Annis

(74) *Attorney, Agent, or Firm* — Womble Bond Dickinson (US) LLP

(57) ABSTRACT

The present disclosure describes a garment, such as a shirt, having first and second sleeves, each of which comprises a sleeve retention mechanism that includes (a) a button affixed to an exterior surface of the sleeve and (b) a tab loop affixed to an interior surface of the sleeve. The shirt is configured so that, when the sleeve is rolled up, i.e. when the distal end of the sleeve is folded outward and toward the proximal end of the sleeve, a predetermined number of times, the tab loop is positioned substantially adjacent to the exterior button so that the tab loop may be secured to the button to retain the sleeve in the rolled-up position.

21 Claims, 27 Drawing Sheets

(56) References Cited

U.S. PATENT DOCUMENTS

| | | | | | |
|---|---|---|---|---|---|
| 5,787,511 | A * | 8/1998 | Garside | A41F 19/005 | 2/232 |
| 6,081,925 | A | 7/2000 | Reiber | | |
| 6,148,445 | A * | 11/2000 | Spruill | A41D 1/04 | 2/116 |
| D534,334 | S * | 1/2007 | Davis | D2/720 | |
| 7,634,818 | B1 * | 12/2009 | Trujillo | A41D 13/04 | 2/269 |
| 7,650,650 | B2 * | 1/2010 | Voege | A41D 1/04 | 2/125 |
| 9,603,399 | B1 * | 3/2017 | Scemla | A41D 27/10 | |
| 2009/0235434 | A1 * | 9/2009 | Ratcliffe | A41D 15/002 | 2/269 |
| 2010/0299802 | A1 * | 12/2010 | Bailey | A41B 13/005 | 2/70 |
| 2012/0233738 | A1 | 9/2012 | Blauer et al. | | |
| 2012/0266364 | A1 * | 10/2012 | Dyon | A41B 7/02 | 2/244 |
| 2017/0071779 | A1 * | 3/2017 | Edgar | A61F 5/3746 | |
| 2018/0213868 | A1 * | 8/2018 | Eldredge | A41F 1/002 | |

* cited by examiner

SHIRT HAVING RETAINER FOR ROLLED-UP SLEEVES

BACKGROUND

The present disclosure generally relates to clothing, and more specifically to a shirt or other garment having a retainer for rolled-up sleeves.

Many individuals like to "roll up" the sleeves of a long sleeve shirt. This is typically done by unbuttoning one or more buttons which may be located on the cuff of the sleeve and then folding the cuff outward and upward. The preferred number of folds varies by individual, although a common preference is to fold the cuff (and any subsequent overlapping layers present after a previous fold) two or three times. When an individual is particularly active, however, the rolled-up sleeve may tend to come undone. This can result in an unkempt appearance and/or, worse, result in the unrolled sleeves interfering with the individual's various activities. Accordingly, some shirts contain features for retaining the sleeves in a rolled-up position.

The most common sleeve retention device involves a button attached to the exterior of the sleeve and a long strip of fabric attached to the interior of the sleeve. The long strip of fabric contains a button hole at or near the free end. As the wearer rolls up his or her sleeves, the long strip of fabric will become exposed, allowing the wearer to pull the fabric strip up around the free end of the sleeve and, using the button hole at or near the free end of the fabric strip, fasten it to the button on the exterior of the sleeve. In this way, the fabric strip creates a loop that holds the sleeve in a rolled-up position.

Another common sleeve retention device moves the button to a location on the fabric strip itself and replaces the exterior button with a small loop of fabric. Just as in the previously-described design, as the wearer rolls up his or her sleeves, the long strip of fabric becomes exposed, allowing the wearer to pull the fabric strip up around the free end of the sleeve. Instead of fastening the free end of the strip to the exterior of the sleeve, however, the wearer threads the fabric strip up through the exterior loop and then back down so that the button hole at or near the free end of the strip can be attached to the button located elsewhere on the fabric strip. As in the previously-described design, this creates a loop that holds the sleeve in a rolled-up position.

Both of these designs are easy to manufacture and easy for a wearer to use. However, they each involve a relatively long strip of fabric. The long strip of fabric increases manufacturing costs, especially when one takes into account the amount of fabric needed to place such strips on shirts manufactured in volume. Additionally, the long strip of fabric may cause discomfort when the sleeves are at full length, as it will contact the wearer's arm and generally increases the bulkiness of the shirt. The long strip of fabric can also be a nuisance when the sleeves are rolled up, as it may tend to stick out the bottom of the sleeve when a wearer roll his or her sleeves up only partially or when a wearer rolls the sleeves up fully but does not wish to use the retention mechanism. Finally, even when used to maintain the sleeves in a rolled-up position, the loop created by the long strip of fabric has the potential to get caught or snagged during various activities and adds a significant, and potentially undesirable depending on an individual's preference, visual element to the shirt.

Accordingly, it is an object of the present disclosure to provide a garment, such as a shirt (which, as used herein, should be understood to include any garment having sleeves for a wearer's arms, e.g. jackets, coveralls, etc.) having an improved sleeve retention mechanism. In particular, it is an object of the present disclosure to provide a shirt having a sleeve retention mechanism that (a) is less expensive to manufacture than the designs described above, (b) provides a wearer with greater versatility in terms of how he or she chooses to roll up the sleeves, and (c) has a more streamlined appearance that does not involve large loops of fabric.

SUMMARY

Embodiments of the present disclosure are directed to a shirt comprising a sleeve retention mechanism. The shirt may comprise a first sleeve and a second sleeve, each of which can be defined as having a proximal end and a distal end. The proximal end of the sleeve is attached to the body of the shirt and the distal end of the sleeve is desirably positioned to fall at the wrist of a wearer. The distal end of the sleeve optionally contains a cuff.

At least one of the first and second sleeves, and more generally each of the first and second sleeves, comprises a sleeve retention mechanism, which includes (a) a button affixed to an exterior surface of the sleeve and (b) a tab loop affixed to an interior surface of the sleeve.

The shirt may be configured so that, when the sleeve is rolled up, i.e. when the distal end of the sleeve is folded outward and toward the proximal end of the sleeve a predetermined number of times, the tab loop is positioned substantially adjacent to the exterior button so that the tab loop may be secured to the button to retain the sleeve in the rolled-up position. By substantially adjacent, it is not meant that the tab loop must be exactly aligned with the button, but rather that the tab loop must be close enough to the exterior button to be secured to the button without a significant amount of fabric. For instance, in some embodiments, it may be desirable that the tab loop fall slightly distally from the exterior button so that a user stretches the tab loop slightly in order to create a secure attachment to the exterior button. In some embodiments, the tab loop and the exterior button may be sized and configured having similar dimensions, thereby providing a relatively snug fit of the tab loop around the button (and minimizing the amount of free fabric present when the loop is secured to the button).

Desirably, the tab loop has relatively small dimensions compared to the conventional sleeve retention designs described in the Background. For instance, in some embodiments, the tab loop has a fixed end and a free end, and the distance between the fixed end and the free end is less than 4 inches, alternatively less than 3 inches, alternatively less than 2 inches, alternatively less than 1 inch, alternatively less than 0.5 inches. In some embodiments, the tab loop may be elastic. In other embodiments, the tab loop may be made out of the same fabric as the sleeves and of the shirt in general. The fixed end of the tab loop may be attached to the interior of the sleeve through any conventional manner, and typically be sewing. In some embodiments, the fixed end of the tab loop may be sandwiched between the interior of the sleeve and an additional patch of fabric, which secures the fixed end of the tab loop to the sleeve.

In some embodiments, the first and second sleeves each include a cuff having a defined width. In such embodiments, the predetermined folding of the sleeve may be based on the width of the cuff. For instance, each time the distal end of the sleeve is folded toward the proximal end of the sleeve, the sleeve is shortened by a distance that substantially corresponds to the width of the cuff. Also, a fixed point at the distal end of the sleeve prior to the fold will be moved proximally a distance that substantially corresponds to double the width of the cuff. As an example, if a cuff has a width of 2 and ½ inches, a wearer that folds the cuff outward and toward the proximal end will generally move a point at the distal end of the cuff between about 5 and 6 inches in the proximal direction. The predetermined number of folds (i.e., rolls) needed to bring the tab loop into substantial alignment with the exterior button may vary depending on the desired position of the rolled-up sleeves on the arm of a wearer, e.g. just below the elbow, just above the elbow, etc. In many embodiments, however, the predetermined number of rolls may be two, three, or four.

In order to ensure that the tab loop is brought into substantial alignment with the exterior button when the sleeve is in a rolled-up position, the tab loop may be located at a defined distance below the exterior button. For instance, in some embodiments, the tab loop may be located between about 4 inches and about 8 inches distally from the button, alternatively between about 5 inches and about 7 inches distally from the button, alternatively about 6 inches distally from the button.

For example, in one embodiment, the tab loop may have a distance of less than 3 inches between a fixed end and a free end, desirably less than 2 inches; each of the first sleeve and the second sleeve may comprise a cuff having a width between about 2 inches and about 3 inches; and the tab loop may be positioned between about 5 inches and about 7 inches below the exterior button. Accordingly, when a wearer rolls the sleeve, the tab loop may be brought into a position substantially adjacent to the exterior button, such that a user can easily secure the tab loop to the button in order to retain the sleeve in a rolled-up position. While the exact position of the rolled-up sleeve relative to the arm will depend on the position of the button and the individual wearer, this rolled-up position may generally fall either slightly above or slightly below the elbow of most wearers.

In some embodiments, at least one of the first and second sleeves, and more generally each of the first and second sleeves, further includes a second button affixed to the exterior surface of the sleeve and a second tab loop affixed to the interior surface of the sleeve. The second tab loop may be securable to the second button in the same manner that the first tab loop is securable to the first button. The inclusion of a second button and second tab loop provides a wearer with multiple options for rolling up the sleeve and retaining the sleeve in the rolled-up position. In this way, a shirt may be configured for a user to roll the sleeve a first predetermined number of times, at which point the tab loop may be secured to the first button, or to roll the sleeve a second predetermined number of times—e.g. further up the arm—at which point the second tab loop may be secured to the second button. In some embodiments, for instance, the first button may be positioned so as to retain the sleeve in a position that will fall slightly below the elbow of most wearers and the second button may be positioned so as to retain the sleeve in a position that will fall slightly above the elbow of most wearers.

The second button may be positioned a defined distance proximally from the first button. Similarly, the second tab loop may be positioned a defined distance proximally from the first tab loop. For instance, in one embodiment the second button may be located about one cuff width from the first button, e.g., between 2 and 4 inches proximally from the first button, and the second tab loop may be located about one cuff width from the first tab loop, e.g., between 2 and 4 inches proximally from the first tab loop. In this embodiment, after reaching the first button, i.e. the first rolled-up position, the distal end of the sleeve may be folded outward toward the proximal end of the sleeve one additional time in order to position the second tab loop substantially adjacent to the second button and bring the sleeve into a second rolled-up position. In another embodiment, the second button and the second tab loop may each be located about two cuff widths from the first button and first tab loop, respectively, in which case two additional rolls would separate the first rolled-up position from the second rolled-up position.

The exterior button and, if present, the second exterior button, may also be positioned at defined distances from the proximal end of the sleeve (as measured from the seam at which the sleeve meets the shoulder). For instance, in some embodiments, the exterior button may be positioned about 15 inches, e.g. between 14 and 16 inches, from the proximal end of the sleeve. It has been found that this positioning results in a rolled-up sleeve position that falls slightly below the elbow of most wearers. A second exterior button, to the extent that one is present, may be positioned about 12 inches, e.g. between 11 and 13 inches, from the proximal end of the sleeve. It has been found that this positioning results in a rolled-up sleeve position that falls slightly above the elbow of most wearers. In other embodiments, a single exterior button may be positioned about 12 inches from the proximal end of the sleeve in order to provide a-a rolled-up sleeve position that falls slightly above the elbow of most wearers.

Additional embodiments of the present disclosure are directed to a shirt comprising a sleeve retention mechanism. The shirt may comprise a first sleeve and a second sleeve, each of which can be defined as having a proximal end and a distal end. At least one of the first and second sleeves, and more generally each of the first and second sleeves, comprises a sleeve retention mechanism, which includes (a) a button affixed to an exterior surface of the sleeve and (b) a tab loop affixed to an interior surface of the sleeve. When the sleeve is in a rolled-up position, the tab loop is securable to the button in order to retain the sleeve in the rolled-up position. The tab loop may be located between 4 inches and 8 inches distally from the button, alternatively between 5 inches and 7 inches distally from the button. Moreover, the tab loop may have a fixed end and a free end, wherein the distance between the fixed end and the free end is less than 3 inches, alternatively less than 2 inches. Each of the first and second sleeves may further comprise a cuff having a width between 2 inches and 3 inches. Optionally, each of the first and second sleeves may also comprise a second button affixed to the exterior surface of the sleeve and located proximally from the first button. For example, the second button may be located between 2 inches and 4 inches proximally from the first button. When the sleeve is in a second rolled-up position, the tab loop may be securable to the second button in order to retain the sleeve in the second rolled-up position.

Additional features and advantages will be set forth in the detailed description which follows, and in part will be readily apparent to those skilled in the art from the description or recognized by practicing the various embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

Figure 1:
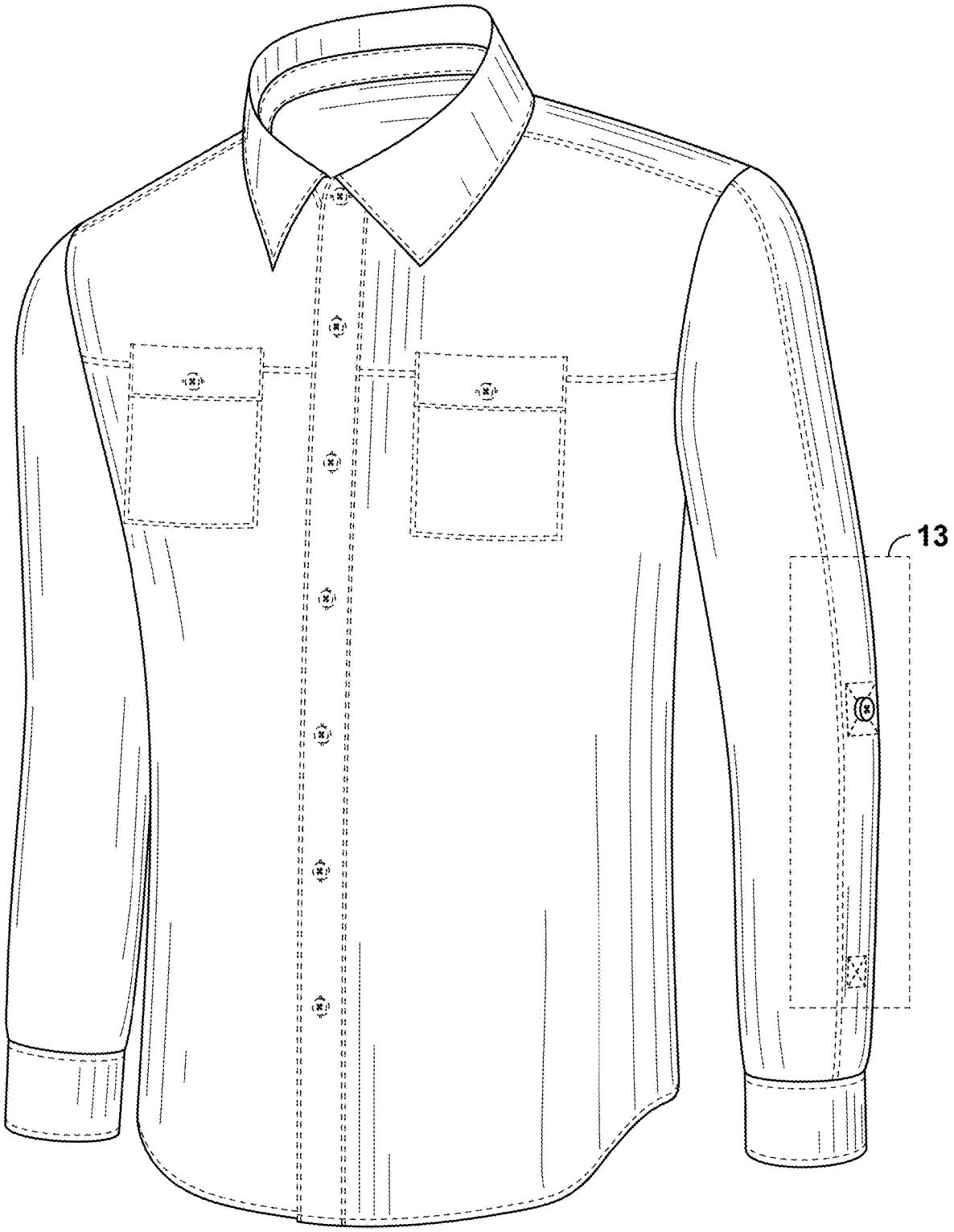
FIG. 1 is a front perspective view of an embodiment of a shirt of the present disclosure in a first position, the first position being an outside-out orientation, displaying a button on the exterior of each of the sleeves.
Figure 2:
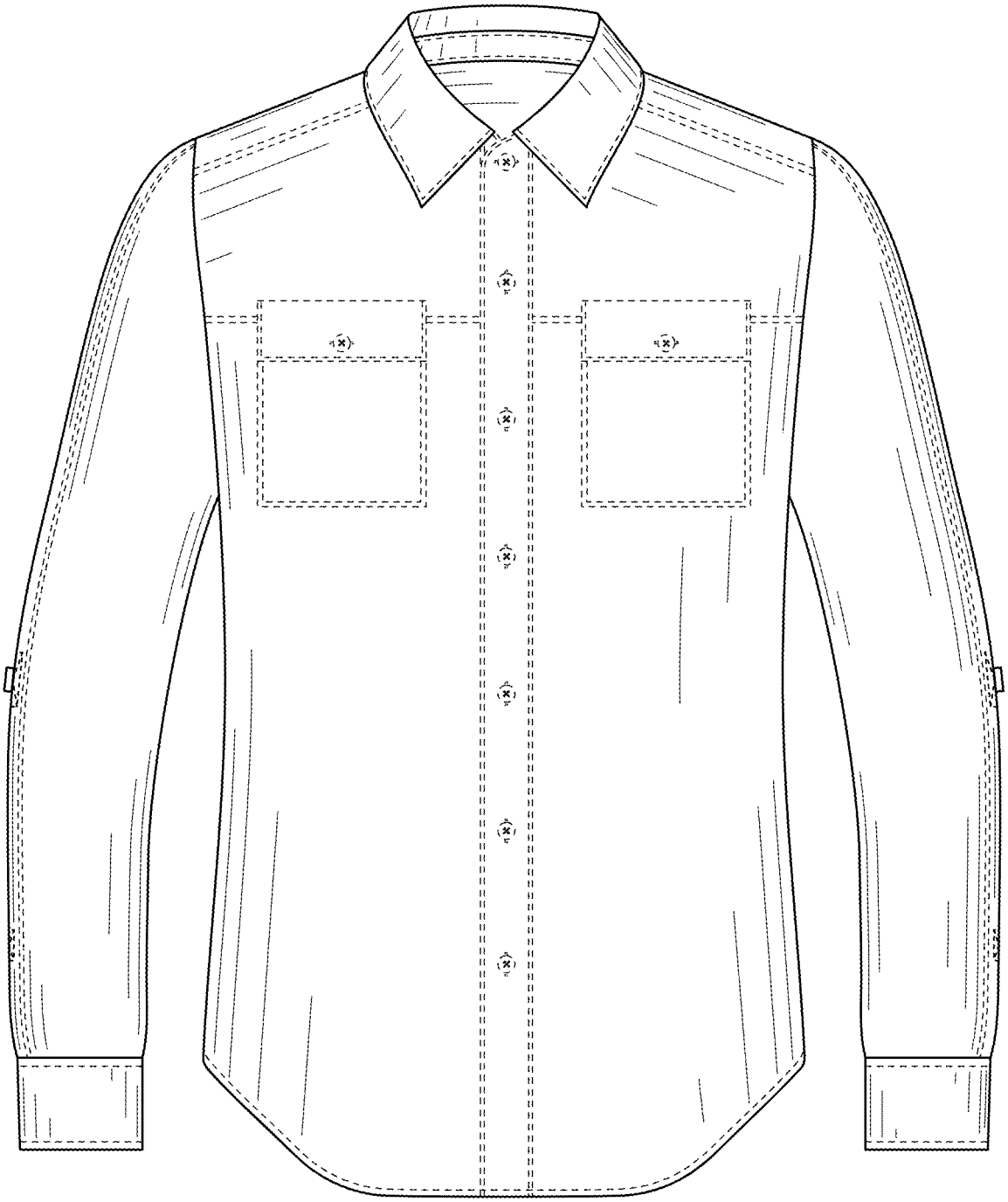
FIG. 2 is a front elevational view of the embodiment of FIG. 1.
Figure 3:
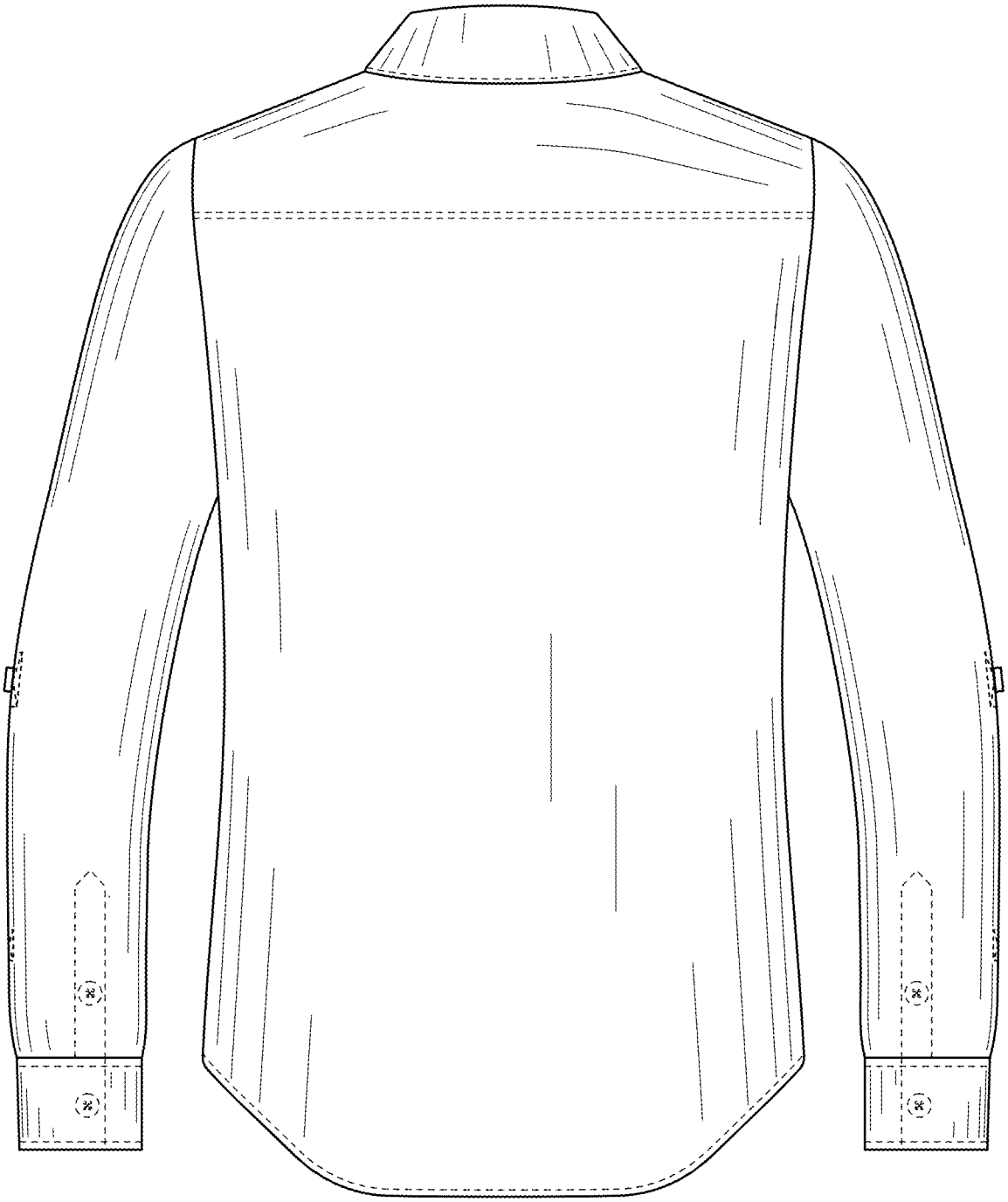
FIG. 3 is a rear elevational view of the embodiment of FIG. 1.
Figure 4:
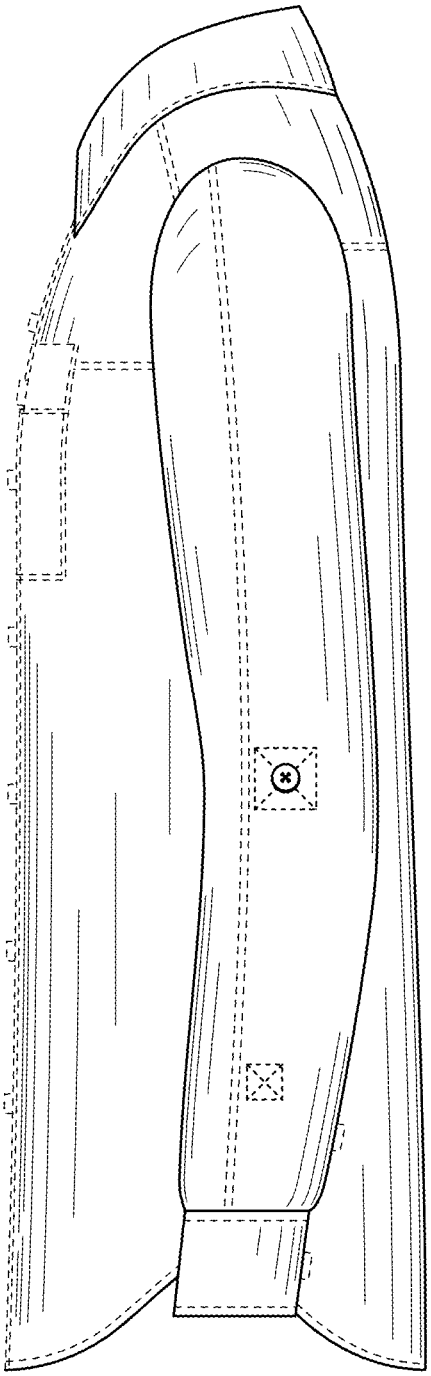
FIG. 4 is a right side elevational view of the embodiment of FIG. 1.
Figure 5:
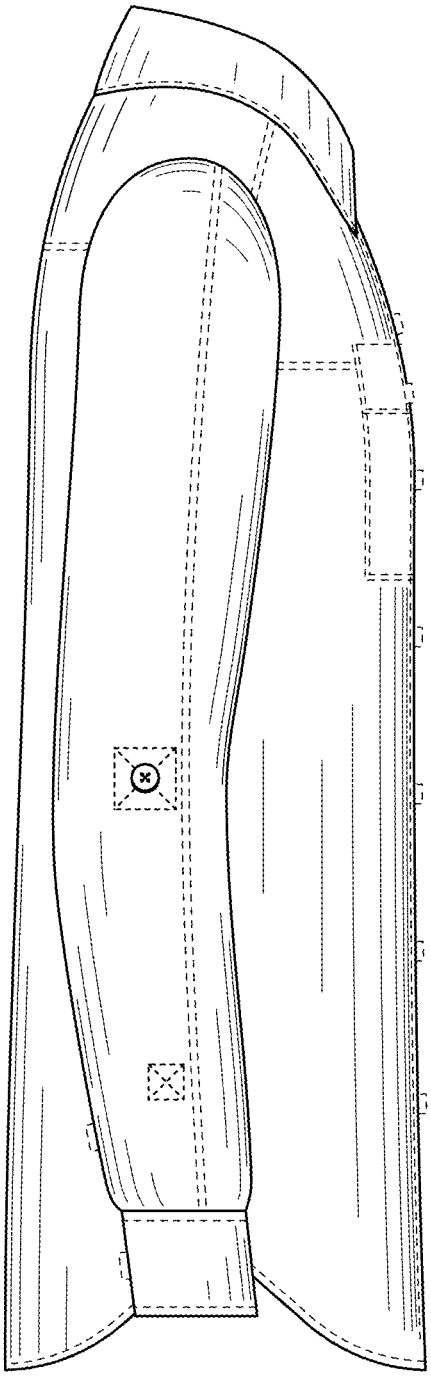
FIG. 5 is a left side elevational view of the embodiment of FIG. 1.
Figure 6:
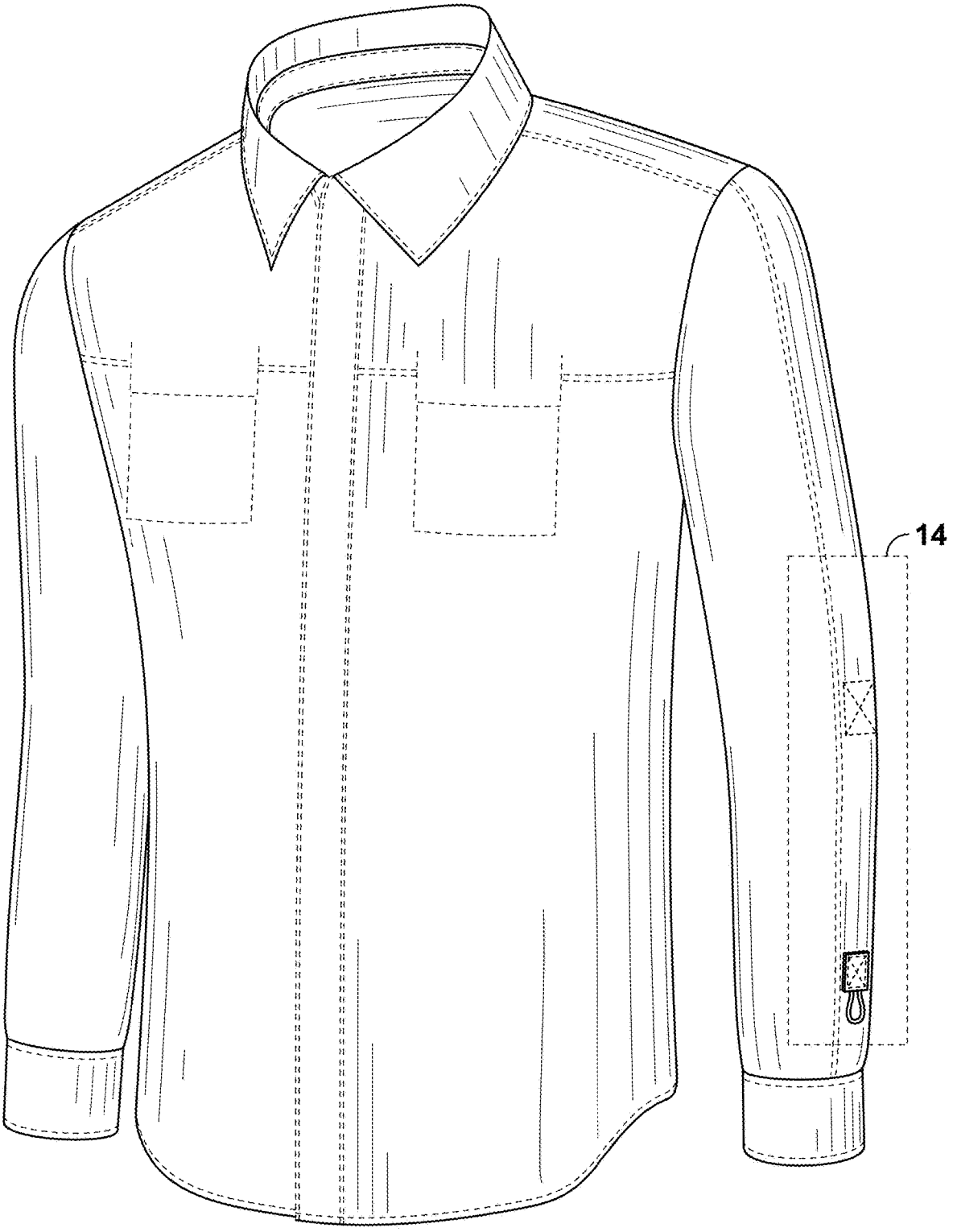
FIG. 6 is a front perspective view of the embodiment of FIG. 1 in a second position, the second position being an inside-out orientation, displaying a tab loop on the interior of each of the sleeves.
Figure 7:
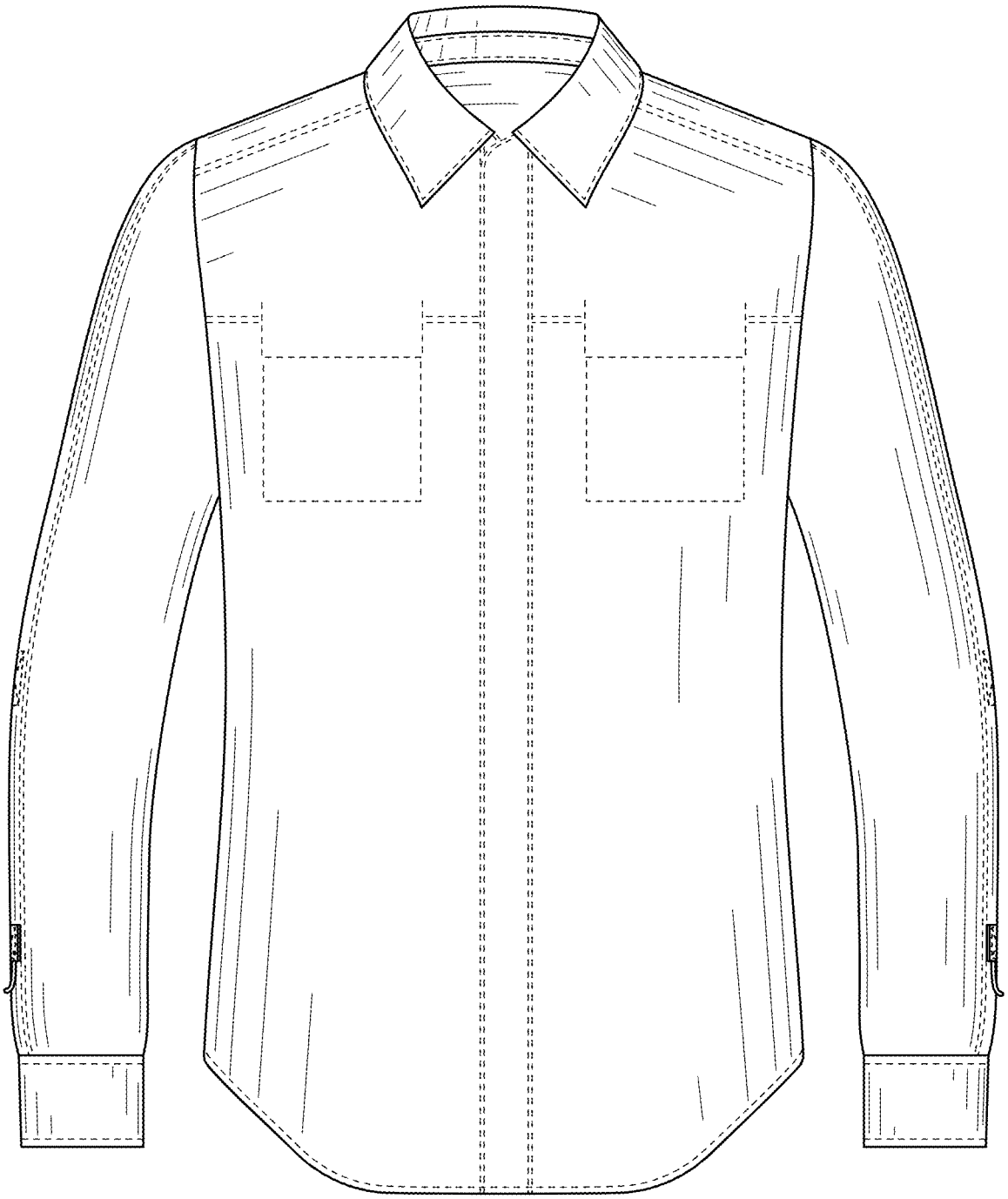
FIG. 7 is a front elevational view of the embodiment of FIG. 1 in an inside-out orientation.
Figure 8:
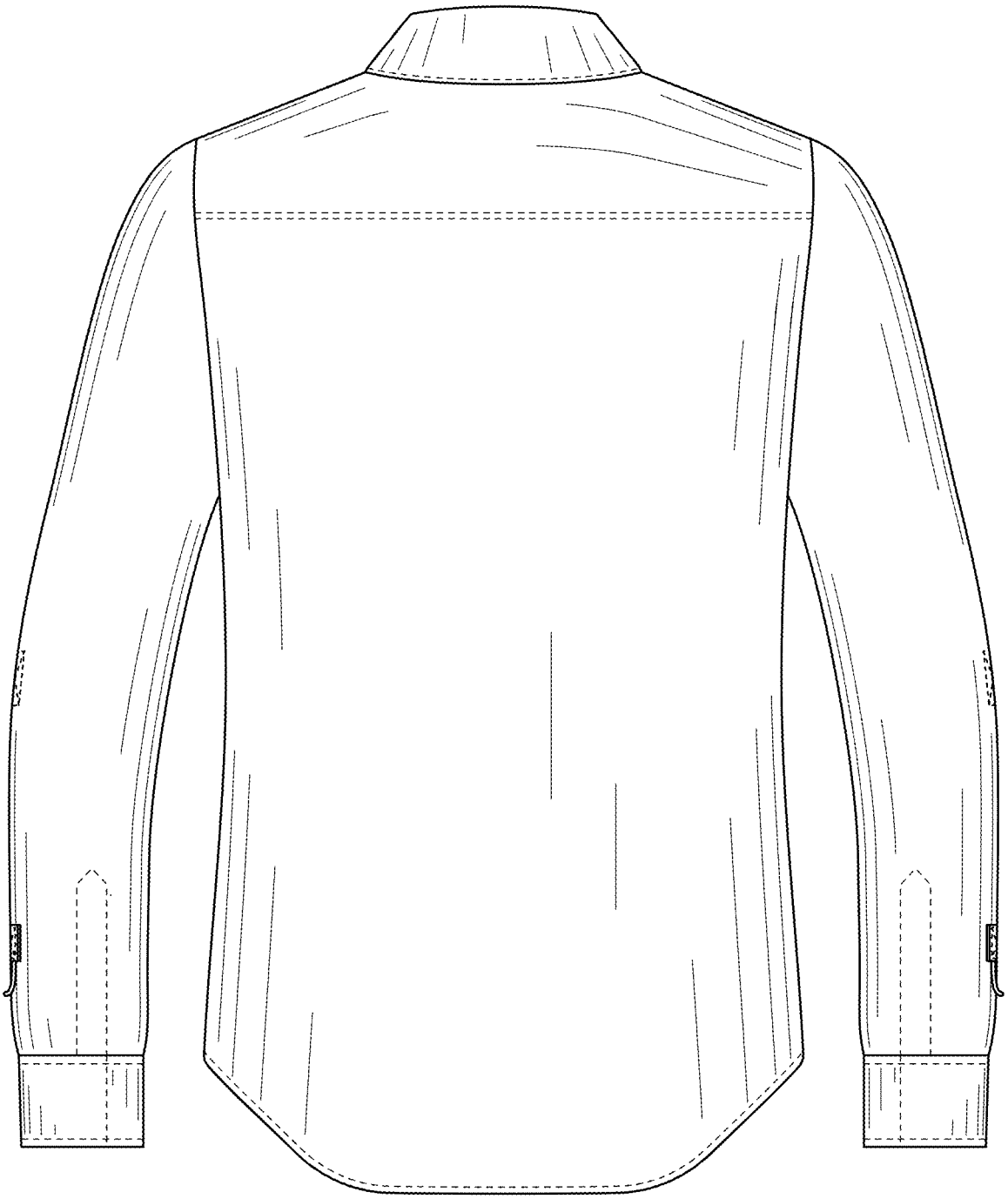
FIG. 8 is a rear elevational view of the embodiment of FIG. 1 in an inside-out orientation.
Figure 9:
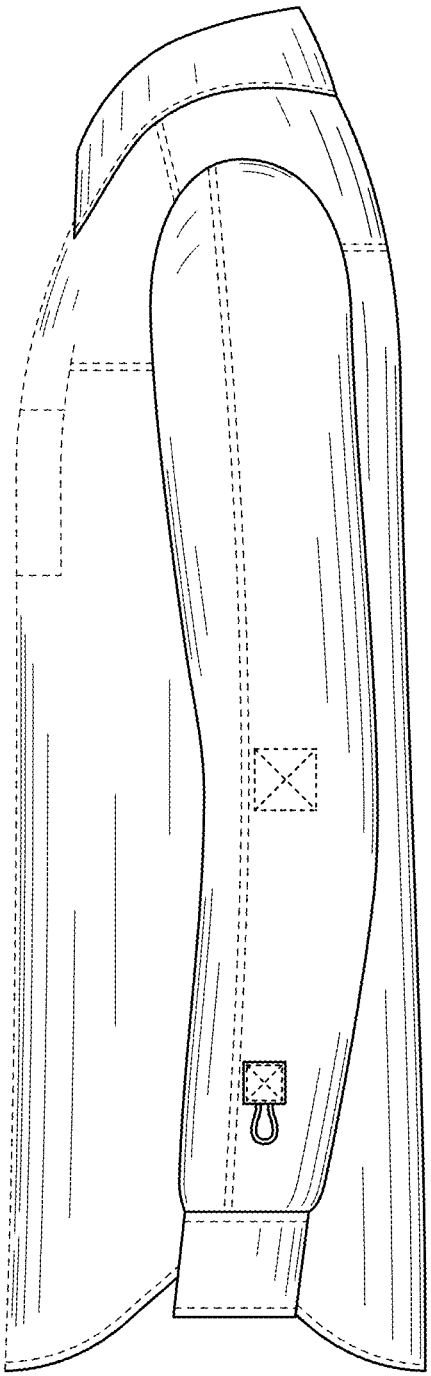
FIG. 9 is a right side elevational view of the embodiment of FIG. 1 in an inside-out orientation.
Figure 10:
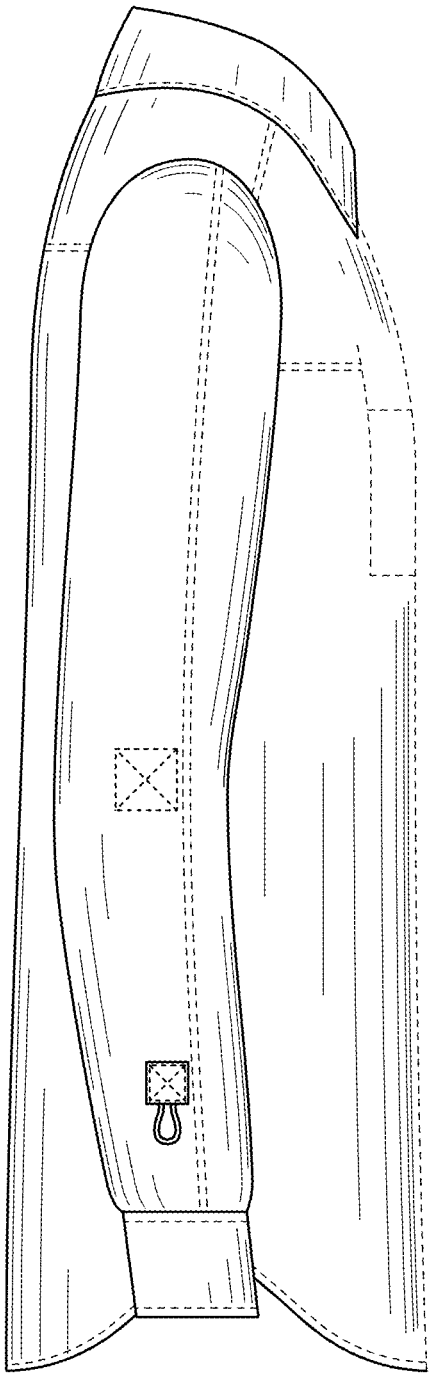
FIG. 10 is a left side elevational view of the embodiment of FIG. 1 in an inside-out orientation.
Figure 11:
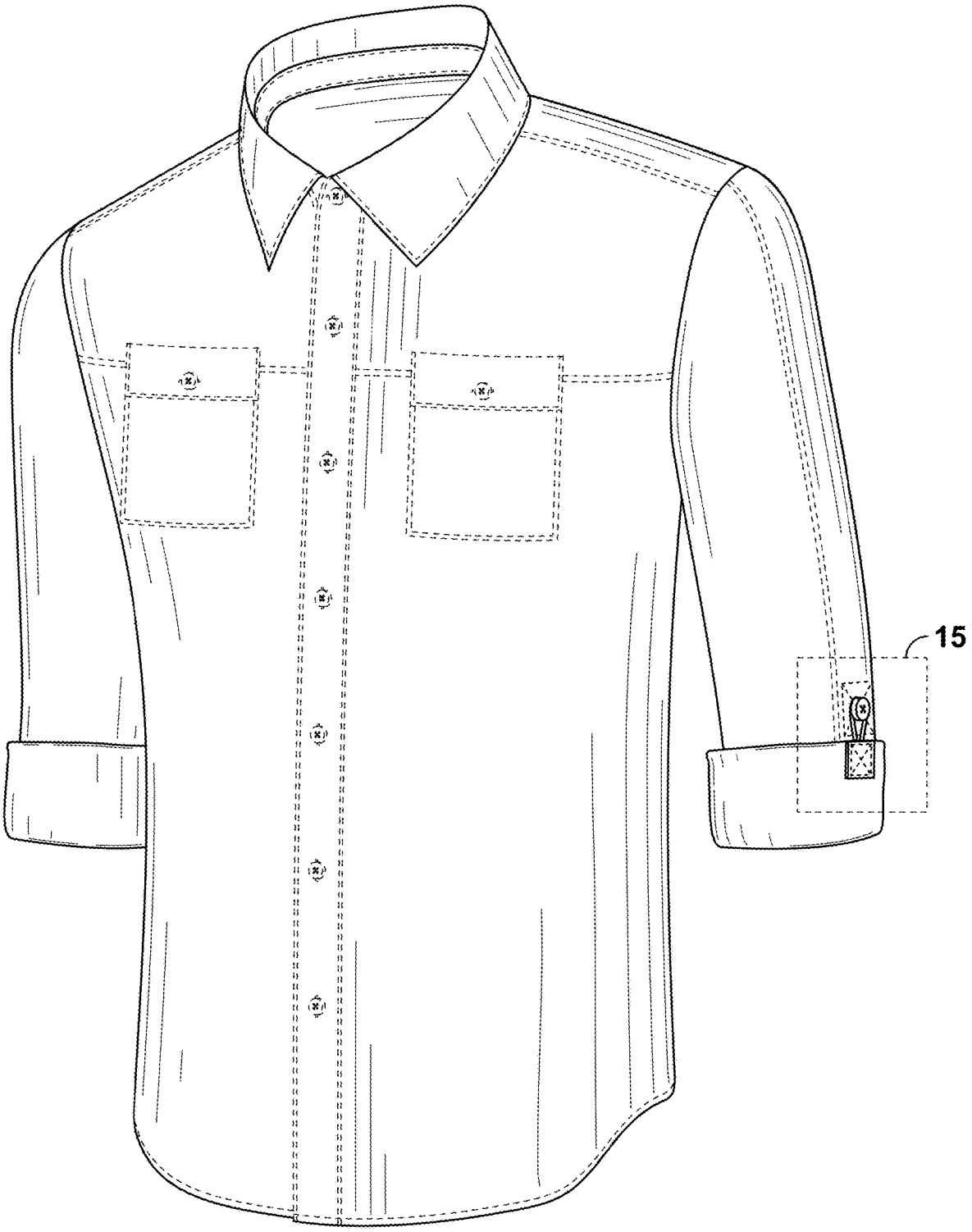
FIG. 11 is a front, right side perspective view of the embodiment of FIG. 1, showing the shirt in a third position, the third position being outside-out with each of the sleeves rolled up and retained in a rolled-up position by the interaction of the button and the tab loop.
Figure 12:
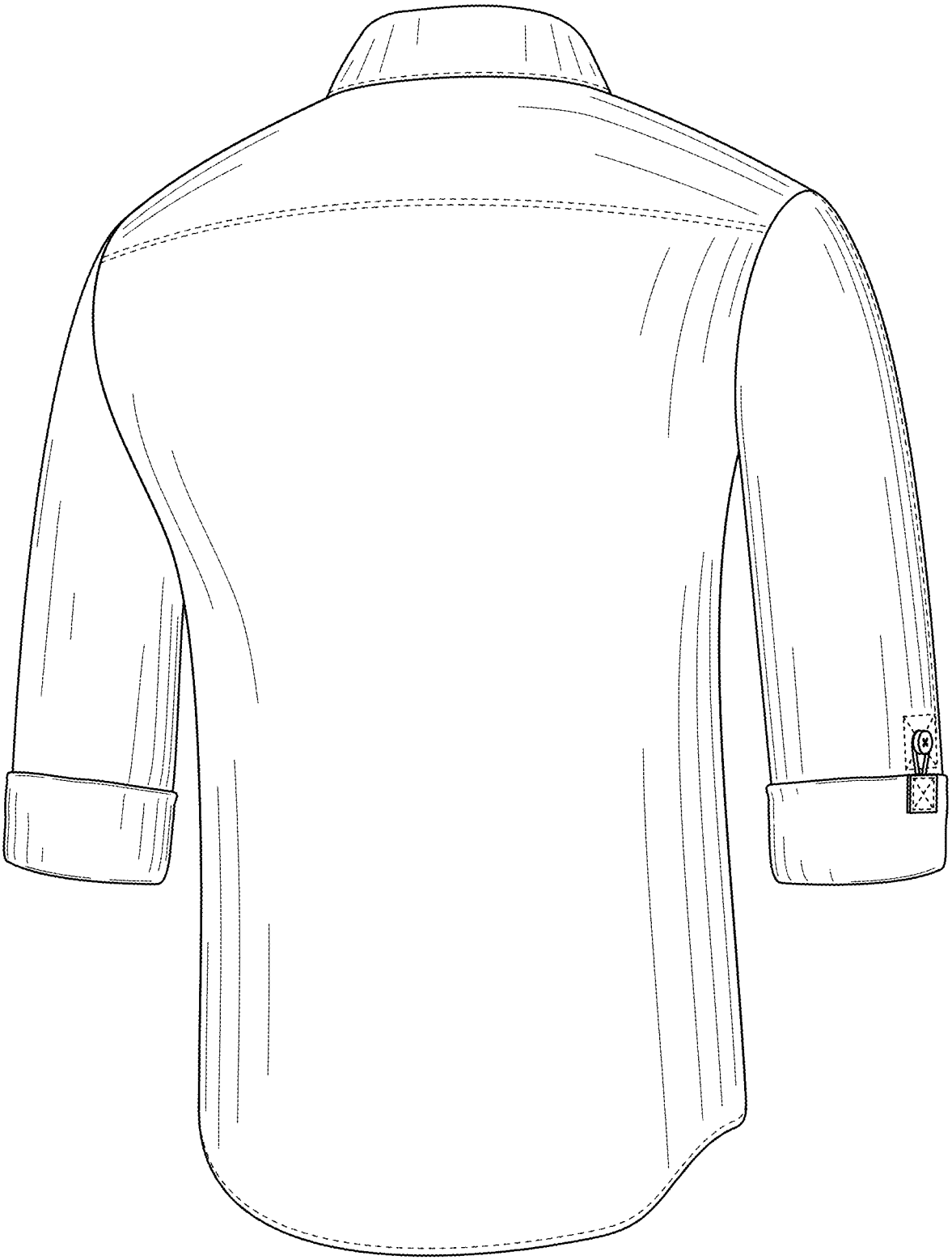
FIG. 12 is a rear, left side perspective view of the embodiment of FIG. 1, showing the shirt in a third position, the third position being outside-out with each of the sleeves rolled up and retained in a rolled-up position by the interaction of the button and the tab loop.
Figure 13:
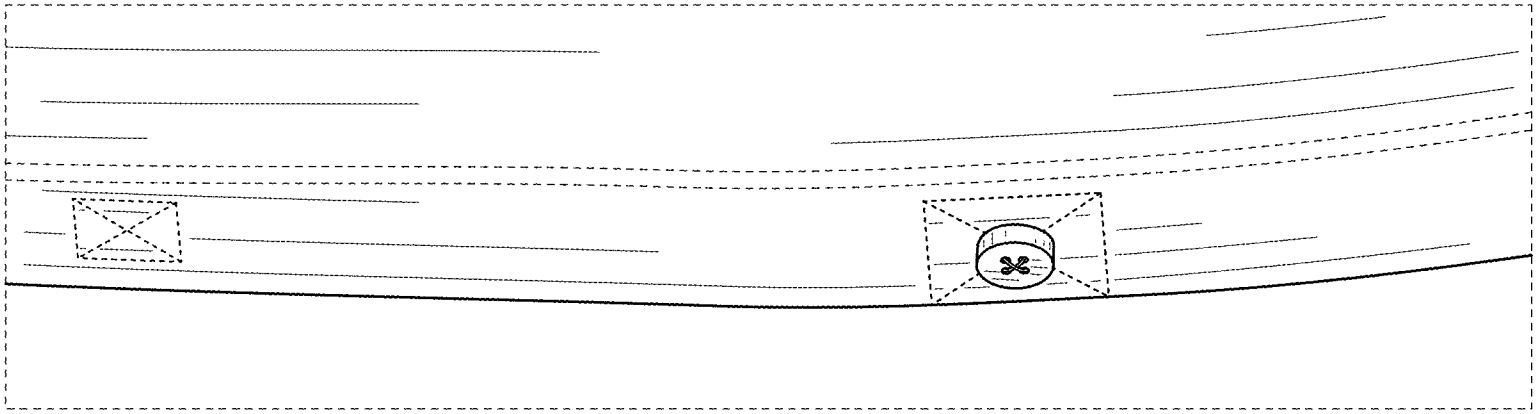
FIG. 13 is a zoomed-in view of a sleeve portion of FIG. 1, showing the button on the exterior of the sleeve.
Figure 14:
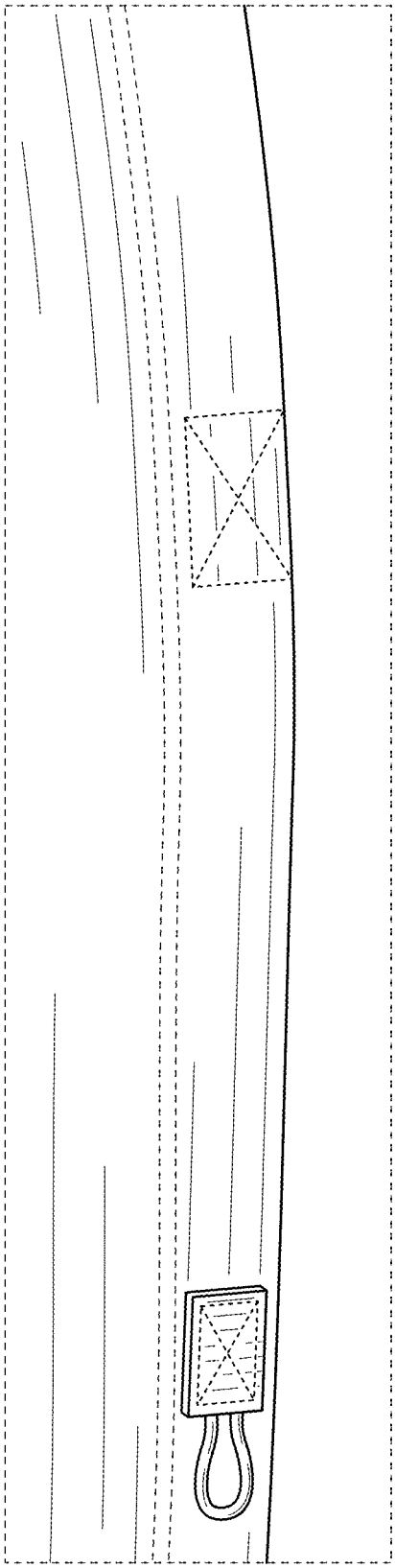
FIG. 14 is a zoomed-in view of a sleeve portion of FIG. 6, showing the tab loop on the interior of the sleeve.

The evenly-dashed broken lines in the drawings illustrate optional features of the shirt, including stitching, that may form no part of a design claimed in an application for United States design patent claiming priority hereto. Similarly, the dot-dash broken lines in FIGS. 16 through 30 defines the bounds of a design that may be claimed in an application for United States design patent claiming priority hereto and form no part of that design.

DETAILED DESCRIPTION OF THE DISCLOSURE

Reference will now be made in detail to certain embodiments, examples of which are illustrated in the accompanying drawings. Whenever possible, the same reference numerals will be used throughout the drawings to refer to the same or like parts.

As an initial matter, the term "shirt" is used throughout the disclosure to refer to any garment having at least a portion that is designed to cover the upper body (i.e., the portion of the body above the waist) of a wearer. Therefore, while the illustrated embodiments show a button-up shirt having a collar, the present disclosure is intended to cover other types of shirts (button-up and non-button up, collared and non-collared, etc.), jackets, sweatshirts, outerwear, coveralls, workwear, and the like.

FIGS. 1 to 16 show an embodiment of a shirt 10 in accordance with the present disclosure. The shirt 10 comprises a first sleeve 11 and a second sleeve 12. Each sleeve 11, 12 has a proximal end 13 and a distal end 14. The proximal end 13 is attached to the body of the shirt 10, such as by one or more seams. The distal end 14 of each sleeve 11, 12 comprises a cuff 15 having width, W. In some embodiments, the cuff 15 may have a width, W, between 1 inch and 4 inches, alternatively between 1.5 inches and 3.5 inches, alternatively between 2 inches and 3 inches. The cuff may have one or more (non-illustrated) fasteners, e.g. buttons, snaps, or the like, configured to assist with donning and doffing of the shirt 10.

Each of the first sleeve 11 and the second sleeve 12 comprises a sleeve retention mechanism 20.

The sleeve retention mechanism 20 comprises a button 21 affixed to an exterior surface of the sleeve 11, 12. The button 21 may be affixed anywhere around the circumference of the sleeve 11, 12. Typically, however, button 21 may be affixed to the outer side of the sleeve 11, 12. In some embodiments, for instance, button 21 may be located slightly forward of the outermost point of the sleeve 11, 12, such as in the illustrated embodiment, directly at the outermost point, or slightly rearward of the outermost point. Locating button 21 on the outer side of the sleeve 11, 12 provides a wearer with easy access to the button and has a desirable visual appearance.

Button 21 may also be located substantially anywhere along the length of the sleeve 11, 12. However, the positioning of the button 21 along the length of the sleeve 11, 12 determines the height of the sleeve when it is in a rolled-up and retained position. Accordingly the button 21 is generally positioned at some point near the midpoint of the sleeve (since most people like to roll their sleeves either just below the elbow or just above the elbow). For instance, in some embodiments, button 21 may be positioned between about ten inches and about seventeen inches from the proximal end 13 of the sleeve 11, 12, and in particular from the point 16 where the sleeve meets the top of the shoulder. Alternatively, button 21 may be positioned between about eleven inches and about sixteen inches from the proximal end 13 of the sleeve 11, 12, and in particular from the point 16 where the sleeve meets the shoulder. Alternatively, button 21 may be positioned between about twelve inches and about fifteen inches from the proximal end 13 of the sleeve 11, 12, and in particular from the point 16 where the sleeve meets the shoulder.

In some embodiments, particularly where a rolled-up position just below the elbow of a wearer is desired, button 21 may be positioned between about ten and about fourteen inches from the proximal end 13 of the sleeve 11, 12, alternatively between about eleven and about thirteen inches from the proximal end of the sleeve. In other embodiments, particularly where a rolled-up position just above the elbow of a wearer is desired, button 21 may be positioned between about thirteen and about seventeen inches from the proximal end 13 of the sleeve 11, 12, alternatively between about fourteen and about sixteen inches from the proximal end of the sleeve.

The button 21, itself, may take on any appearance in order to facilitate a desired appearance of the shirt 10. In some embodiments button 21 may not have the conventional appearance of a button, so long as it is generally rigid element affixed to the sleeve 11, 12 and extending at least some distance from the exterior surface of the sleeve in order to enable the attachment of a tab loop between the button and the sleeve.

In some embodiments, the button 21 may be secured to the shirt with one or more fabric patches. For instance, in some embodiments, the sleeve 11, 12 may comprise a patch of fabric located on the interior of the shirt directly behind the button. The inclusion of a fabric patch further prevents the button 21 from being pulled off of the sleeve 11, 12.

The sleeve retention mechanism 20 also comprises a tab loop 22 affixed to an interior surface of the sleeve 11, 12. The tab loop 22 has a fixed end 23 and a free end 24. The fixed end 23 is attached to the interior surface of the sleeve 11, 12. The free end 24 is not. Desirably, the exposed portion of the tab loop 22 spans a short distance between the fixed end 23 and the free end 24, although the tab loop it must be long enough to allow a user to easily grip the loop and place it around the button 21. In some embodiments, for instance, the tab loop 22 spans less than 4 inches between the fixed end 23 and the free end 24, alternatively less than 3 inches, alternatively less than 2.5 inches, alternatively less than 2 inches, alternatively less than 1.5 inches, alternatively less than 1 inch, alternatively less than 0.5 inch. In some preferred embodiments, the exposed portion of the tab loop spans between 1.5 and 2.5 inches between its fixed end 23 and its free end 24, alternatively between 1.5 and 2 inches, alternatively between 1 and 2.5 inches, alternatively between 1 and 2 inches.

In some embodiments, such as the illustrated embodiment, the tab loop 22 may comprise an elastic material, such as an elastic draw cord. In the case of an elastic material, it is noted that the dimensions provided above are for a loop material in a non-stretched state; it is contemplated that, at least in some embodiments, the elasticity may allow the tab loop to stretch beyond the recited dimensions. In other embodiments, the tab loop 22 may be made of a non-elastic material. For instance, the tab loop 22 may be made of the same material as the sleeves 11, 12 and/or the same material as the body of the shirt 10.

Moreover, the tab loop 22 is not limited to the shape shown in the illustrated embodiments. Rather, any shape that may be placed onto and secured to button 21 may be utilized.

The fixed end 23 of the tab loop 22 may be affixed directly to the interior of the sleeve 11, 12. For instance, the fixed end 23 of the tab loop 22 may be sewn to the interior of the sleeve 11, 12. In order to provide a more secure attachment, the fixed end 23 of the tab loop 22 may be secured to the interior of the sleeve by a patch of material 25, which is sewn to the interior of the sleeve 11, 12. In some embodiments, the tab loop 22 may be both sewn to the interior of the sleeve and secured to the sleeve by patch 25. It is noted that the lengths of the tab loops 22 identified above refer to the exposed portion of the tab loop embodiments. In other words, any portion of a tab loop 22 that is covered by patch 25 would not be taken into account in the above length measurements.

The tab loop 22 is affixed at substantially the same position around the circumference of the sleeve 11, 12 as the button 21 (although the tab loop is obviously affixed to the interior of the sleeve while the button is affixed to the exterior of the sleeve). In this way, when the sleeve 11, 12 is rolled up to expose the tab loop 22, the tab loop is located at substantially the same position around the circumference of the sleeve as the button 21 so that the loop may be easily secured to the button. In some embodiments, for example, the tab loop 22 may be located slightly forward of the outermost point of the sleeve 11, 12, such as in the illustrated embodiment, directly at the outermost point, or slightly rearward of the outermost point.

Figure 17:
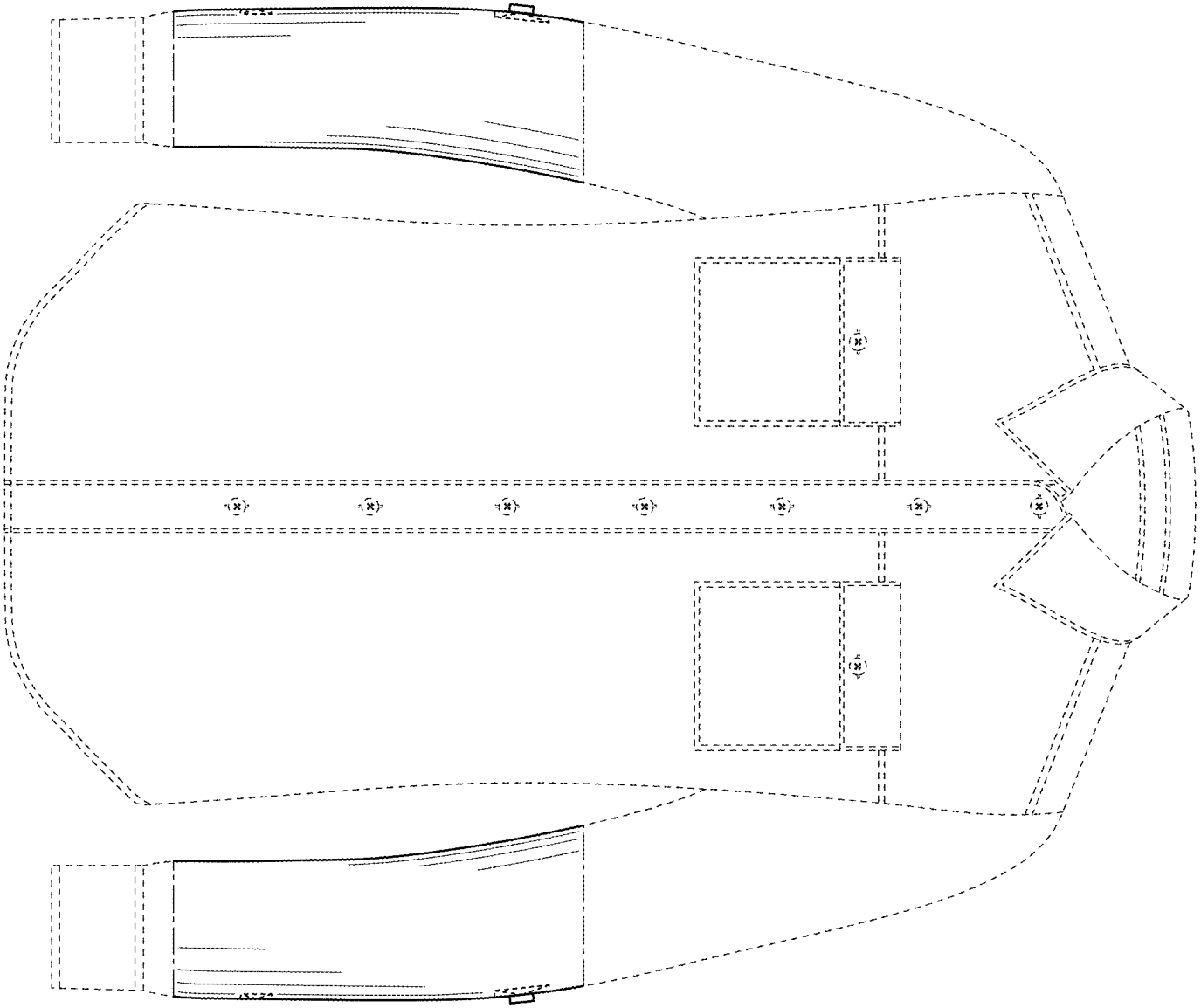
FIG. 17 is a front elevational view of the embodiment of FIG. 16.

The tab loop 22 is also positioned at a defined location along the length of the sleeve 11, 12. For instance, the tab loop 22 may be positioned distally a defined distance, D, from the button 21, as shown in FIG. 17. In some embodiments, the tab loop 22 may be located between 4 and 8 inches distally from the button 21, alternatively between 5 and 7 inches, alternatively between 5.5 and 6.5 inches, alternatively about 6 inches. Where the sleeve 11, 12 comprises a cuff, the distance, D, between the button 21 and the tab loop 22 may be related to the width of the cuff, W.

For instance, when a person rolls up his or her shirt sleeves 11, 12, the most common first step is to fold the cuff 15 of the sleeve outward and upward (i.e. proximally). In doing so, the width of the rolled portion generally corresponds substantially with the width of the cuff, W. Then, if the person desires a second roll, that person will generally fold the two-layer portion made up of the folded cuff 15 and the portion of the sleeve 11, 12 that underlies the folded cuff outward and upward (i.e. proximally) again. If the person desires a third roll, that person will generally fold the three-layer portion that resulted from the second fold, and so on. Accordingly, each roll will tend to have a width that substantially corresponds with the width of the cuff 15. This means that the distal end of the sleeve 14 prior to the fold will travel proximally about twice the width of the cuff, W, during a single fold.

Accordingly, in order to have the tab loop 22 be positioned substantially adjacent to the button 21 after a desired number of folds, the tab loop may be located about twice the width of the cuff, W, or slightly above twice the width of the cuff, W, distally from the button 21. This slight increase to twice the width of the cuff, W, takes into account fabric bunching/bulking as the layers pile. Notably, cuffs 15 on shirt sleeves 11, 12 tend to have fairly standard widths that typically range between 2 and 3 inches. For a 2 and ½ inch cuff, for instance, a distance D of about 6 inches may be optimal.

Figure 15:
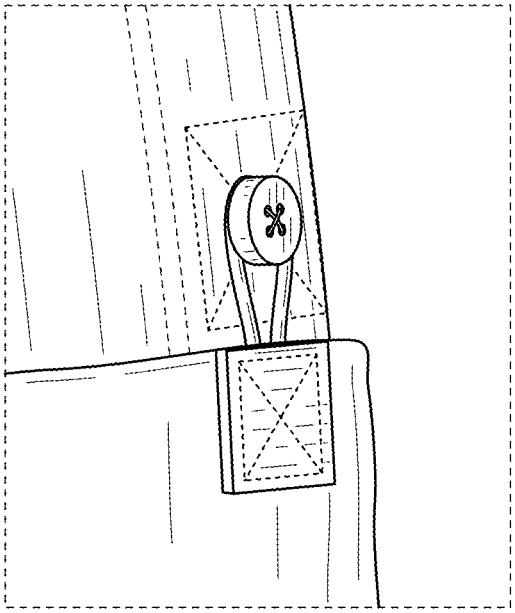
FIG. 15 is a zoomed-in view of a sleeve portion of FIG. 11, showing the interaction between the tab loop and the button when the shirt is in the third position.
Figure 16:
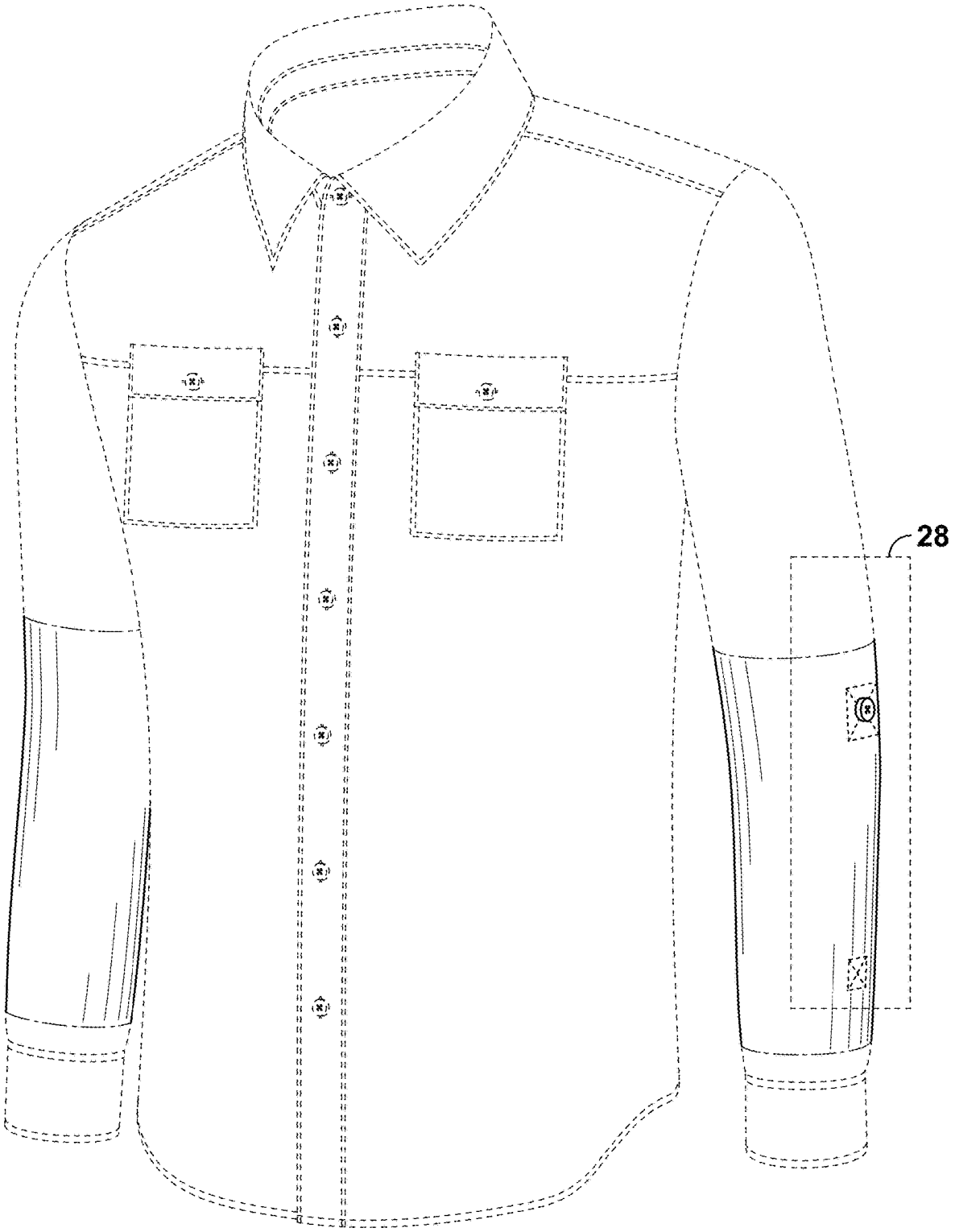
FIG. 16 is a front perspective view of an embodiment of a shirt sleeve portion of the present disclosure in a first position, the first position being an outside-out orientation, displaying a button on the exterior of each of the sleeves.

The tab loop 22 may also be positioned so that it is at or near the distal end 14 of the sleeve 11, 12 prior to the final fold which brings it substantially adjacent to the button 21. In that way, when the sleeve 11, 12 is in the rolled-up position and ready to be secured, the tab loop 22 will desirably be placed at the top of the rolled portion of the sleeve 11, 12, which lands just below the button 21, such as is illustrated in FIGS. 15 and 16.

In the illustrated embodiment, for instance, the patch 25 used to secure the tab loop 22 is desirably positioned directly below the button 21 when the sleeve 11, 12 is in the rolled up position. This makes it easy for a wearer to attach the tab loop 22 to the button 21 so as to secure the tab loop to the button and also provides a clean visual appearance when the sleeve is retained in a rolled-up position. For instance, when the sleeve 11, 12 is in a rolled up position, it may be desirable to have the shirt 10 configured so that patch 25 used to secure the tab loop 22 is positioned within one inch of the button 21, alternatively within ½ inch, alternatively within ¼ inch (measured from the bottom of the button). Where no patch 25 is used, it may be desirable to have the shirt 10 configured so that, when the sleeve 11, 12 is in a rolled up position, the fixed end 23 of the tab loop 22 is positioned within one inch of the button 21, alternatively within ½ inch, alternatively within ¼ inch (measured from the bottom of the button). By having the shirt 10 configured to place the fixed end of the tab loop 23 and/or the patch 25 used to secure the tab loop 22 directly below the button 21, one may also minimize the length of the tab loop.

In some embodiments, the tab loop 22 may be positioned a defined distance proximally from the distal end of the sleeve 14.

Where the shirt 10 includes sleeves 11, 12 having cuffs 15, that defined distance may relate to the width of the cuff, W. For instance, in an embodiment in which the rolled-up position at which the sleeve 11, 12 is configured to be retained requires three folds (i.e., the sleeve is retained after three rolls), the tab loop 22 may be positioned about two cuff-widths, W, above the end of the sleeve 14 (i.e., about one cuff-width, W, above the top of the cuff). In this way, the tab loop 22 may be positioned so that it is at or near the distal end 14 of the sleeve 11, 12 prior to the third, and final, fold which brings it substantially adjacent to the button 21. Similarly, in an embodiment in which the rolled-up position at which the sleeve 11, 12 is configured to be retained requires four folds (i.e., the sleeve is retained after four rolls), the tab loop 22 may be positioned about three cuff-widths, W, above the end of the sleeve 14 (i.e., about two cuff-widths, W, above the top of the cuff). In this way, the tab loop 22 may be positioned so that it is at or near the distal end 14 of the sleeve 11, 12 prior to the fourth, and final, fold which brings it substantially adjacent to the button 21.

In some embodiments, for example, the tab loop 22 may be positioned between about 4 and about 7 inches above the distal end of the sleeve 14, alternatively between about 4 and about 6 inches above the distal end of the sleeve. In other embodiments, the tab loop 22 may be positioned between about 6 and about 10 inches above the distal end of the sleeve 14, alternatively between about 6 and about 9 inches above the distal end of the sleeve.

Because the shirts 10 described herein may be of varying sizes and thus have varying arm lengths, there is no single formula for positioning the button 21 and the tab loop 22. Rather, to be configured so that the tab loop 22 is positioned substantially adjacent the button 21 when the distal end of the sleeve 14 is folded a predetermined number of times to bring the sleeve into a rolled-up position, one of ordinary skill in the art could apply the relationships described herein, also known in the art as grade rules, in order to position the button 21 and the tab loop 22 at a proper location on the sleeve 11, 12 for a shirt 10 having a particular size.

Figure 18:
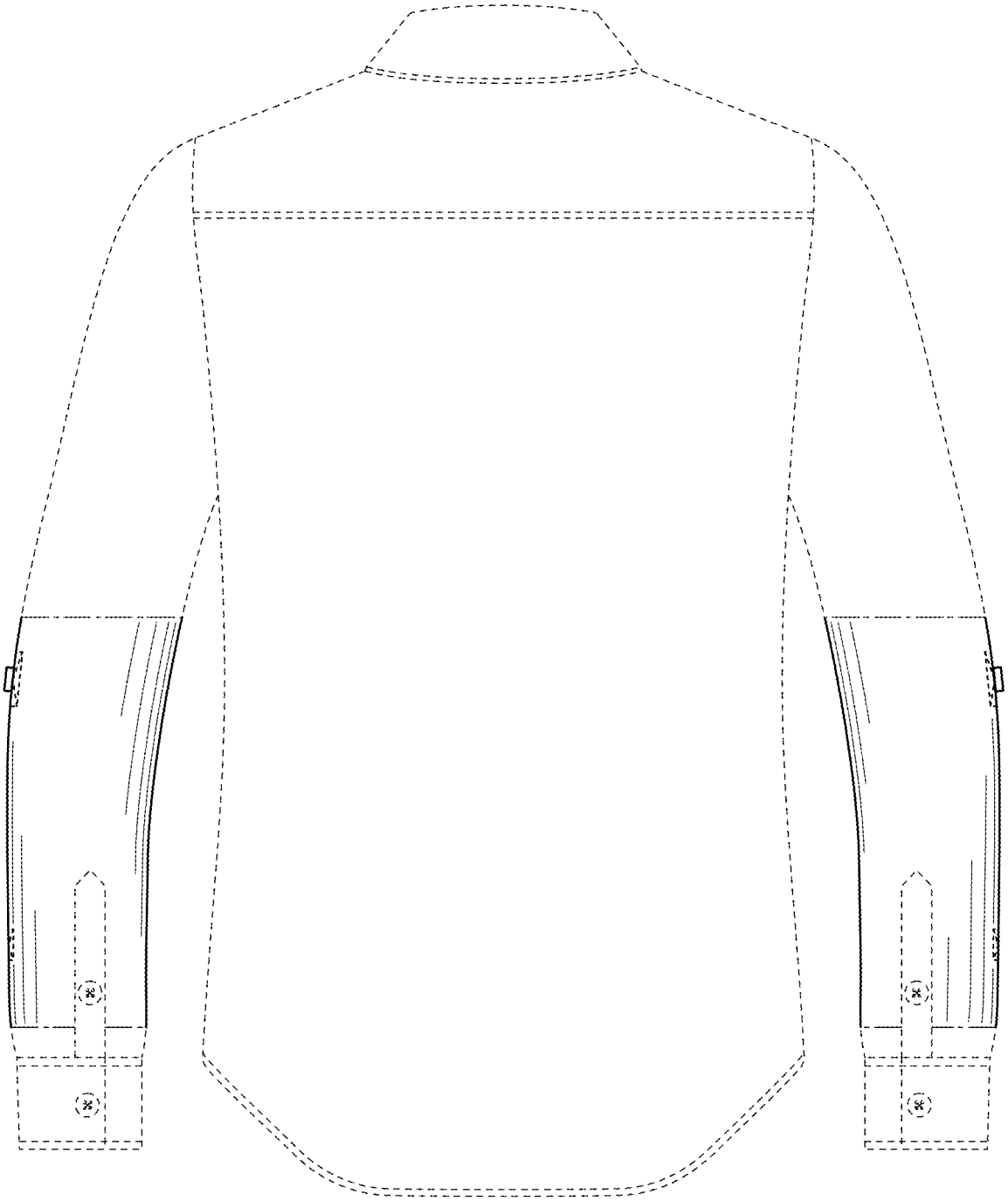
FIG. 18 is a rear elevational view of the embodiment of FIG. 16.
Figure 19:
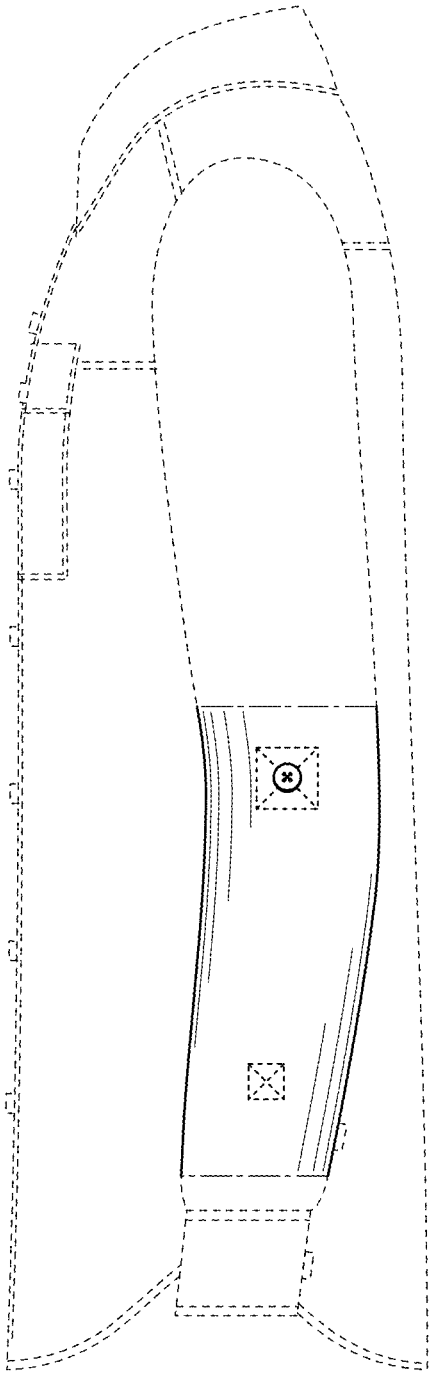
FIG. 19 is a right side elevational view of the embodiment of FIG. 16.
Figure 20:
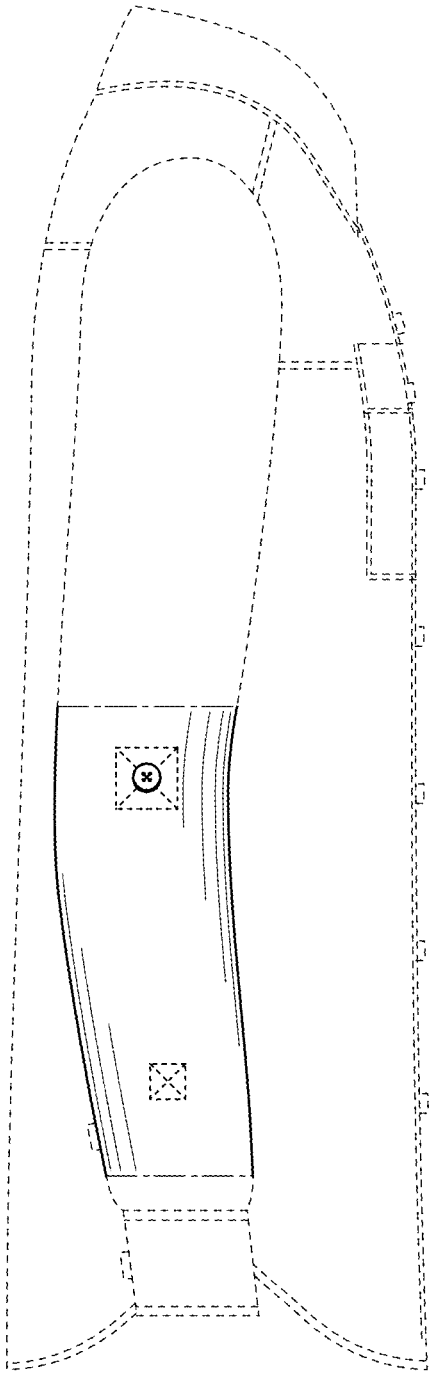
FIG. 20 is a left side elevational view of the embodiment of FIG. 16.
Figure 21:
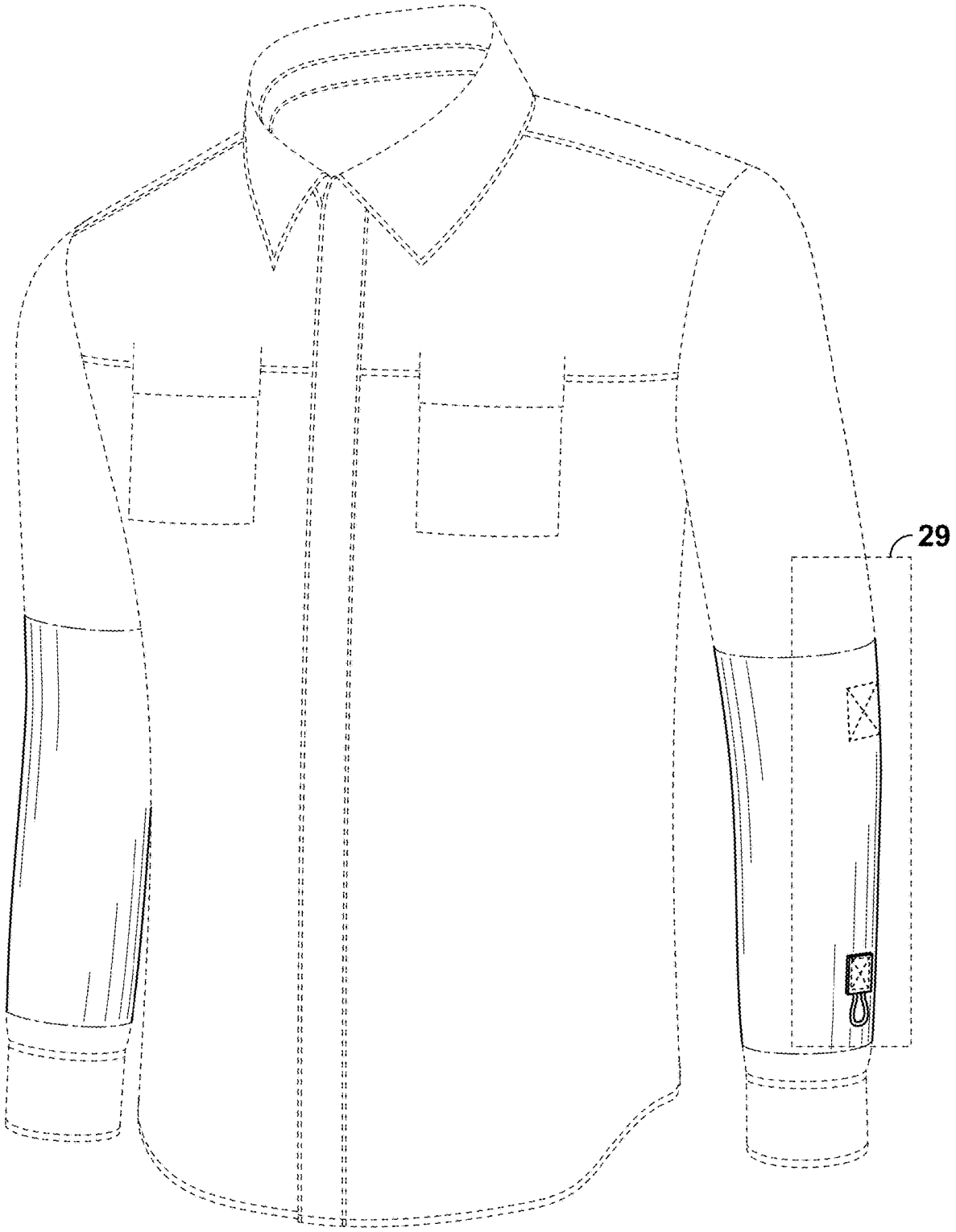
FIG. 21 is a front perspective view of the embodiment of FIG. 16 in a second position, the second position being an inside-out orientation, displaying a tab loop on the interior of each of the sleeves.
Figure 22:
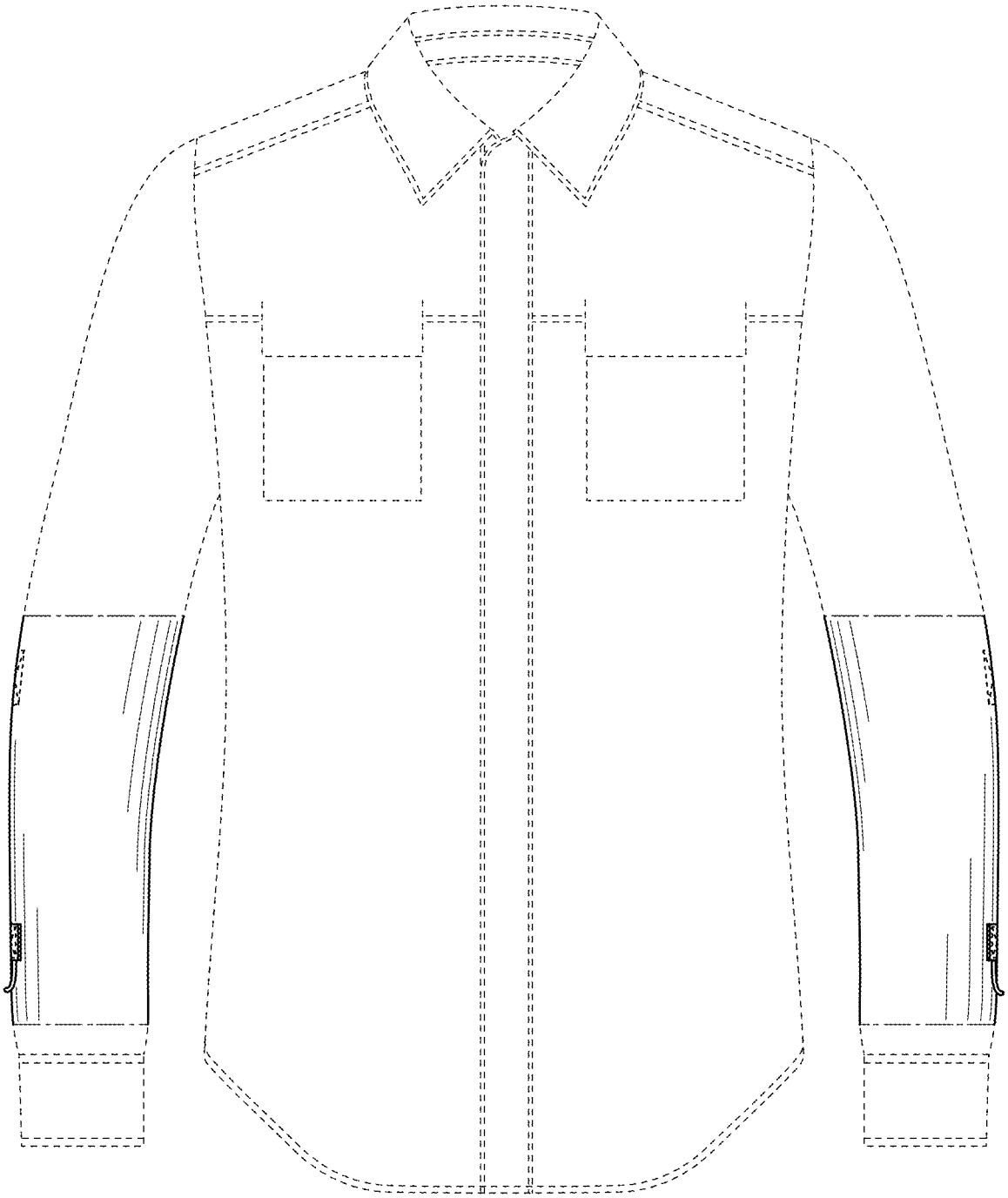
FIG. 22 is a front elevational view of the embodiment of FIG. 16 in an inside-out orientation.
Figure 23:
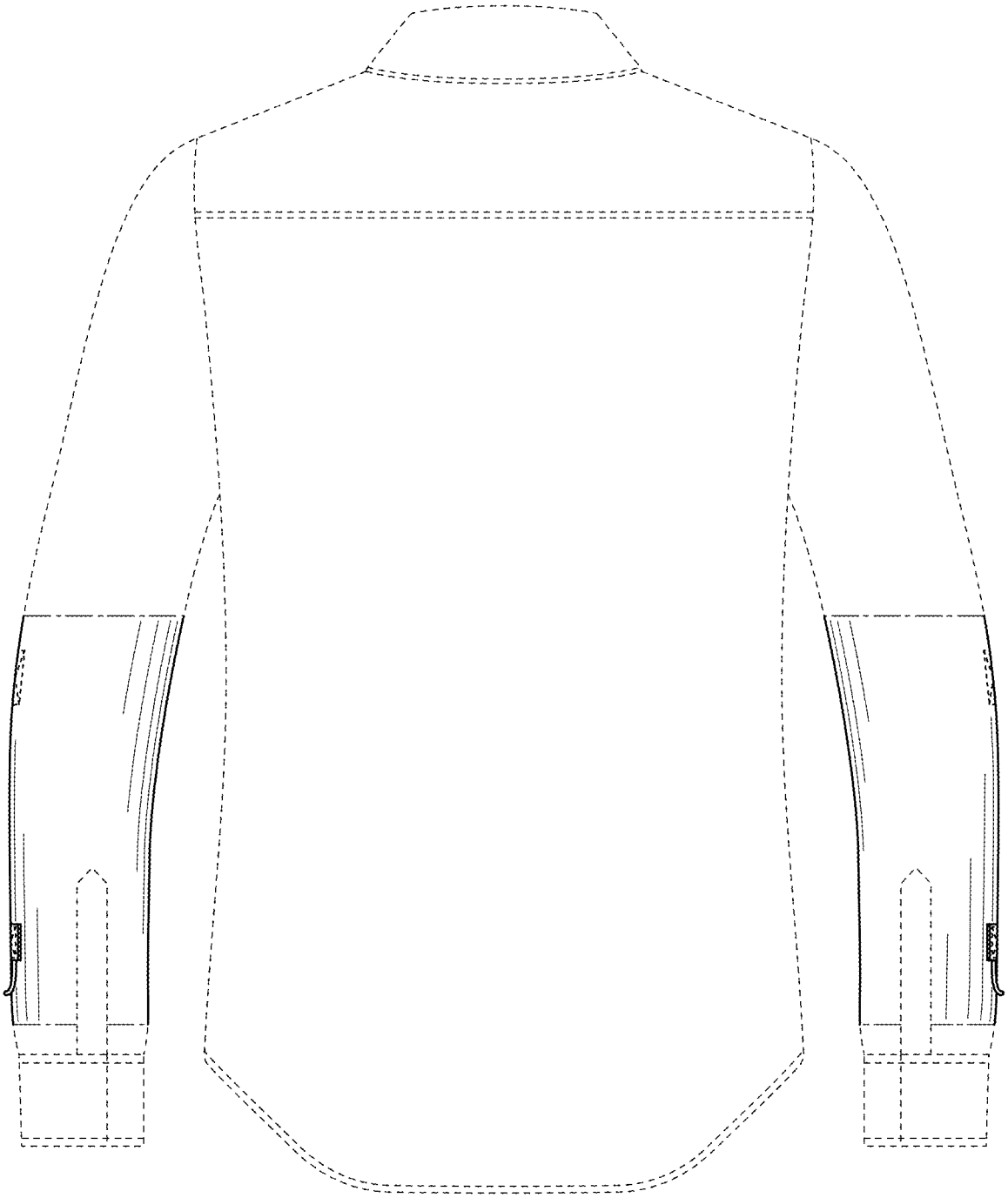
FIG. 23 is a rear elevational view of the embodiment of FIG. 16 in an inside-out orientation.
Figure 24:
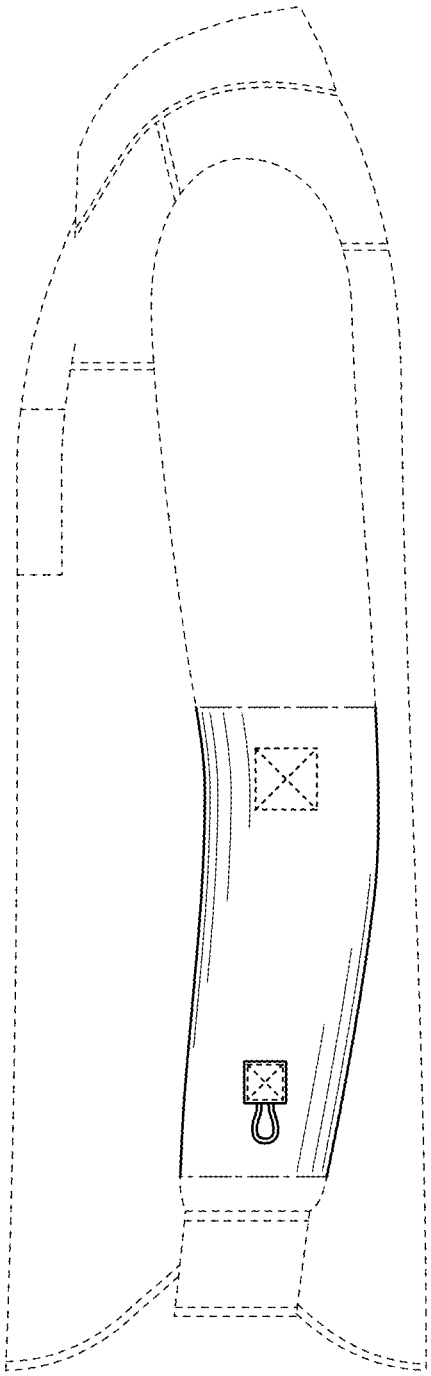
FIG. 24 is a right side elevational view of the embodiment of FIG. 16 in an inside-out orientation.
Figure 25:
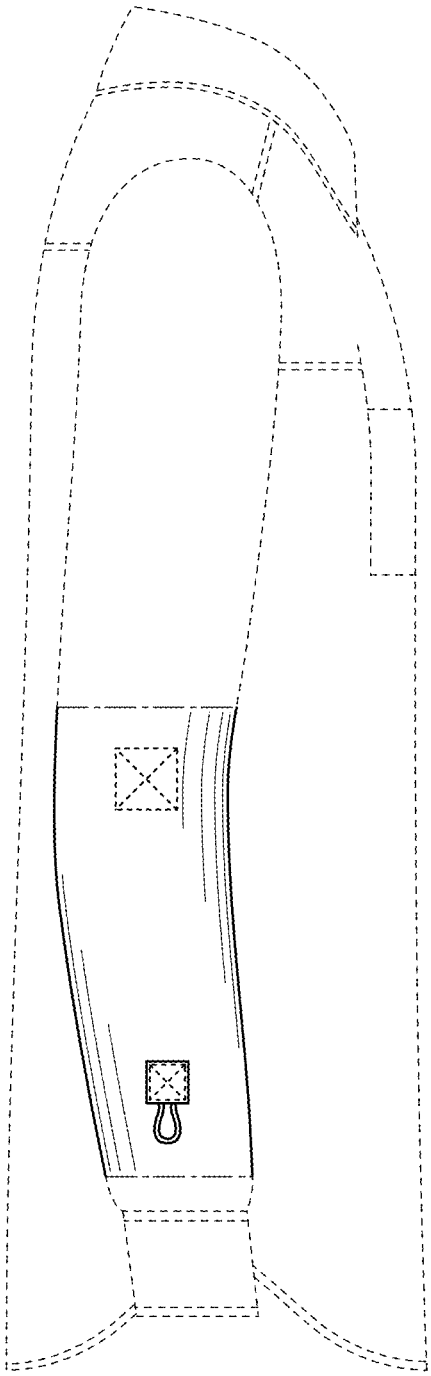
FIG. 25 is a left side elevational view of the embodiment of FIG. 16 in an inside-out orientation.
Figure 26:
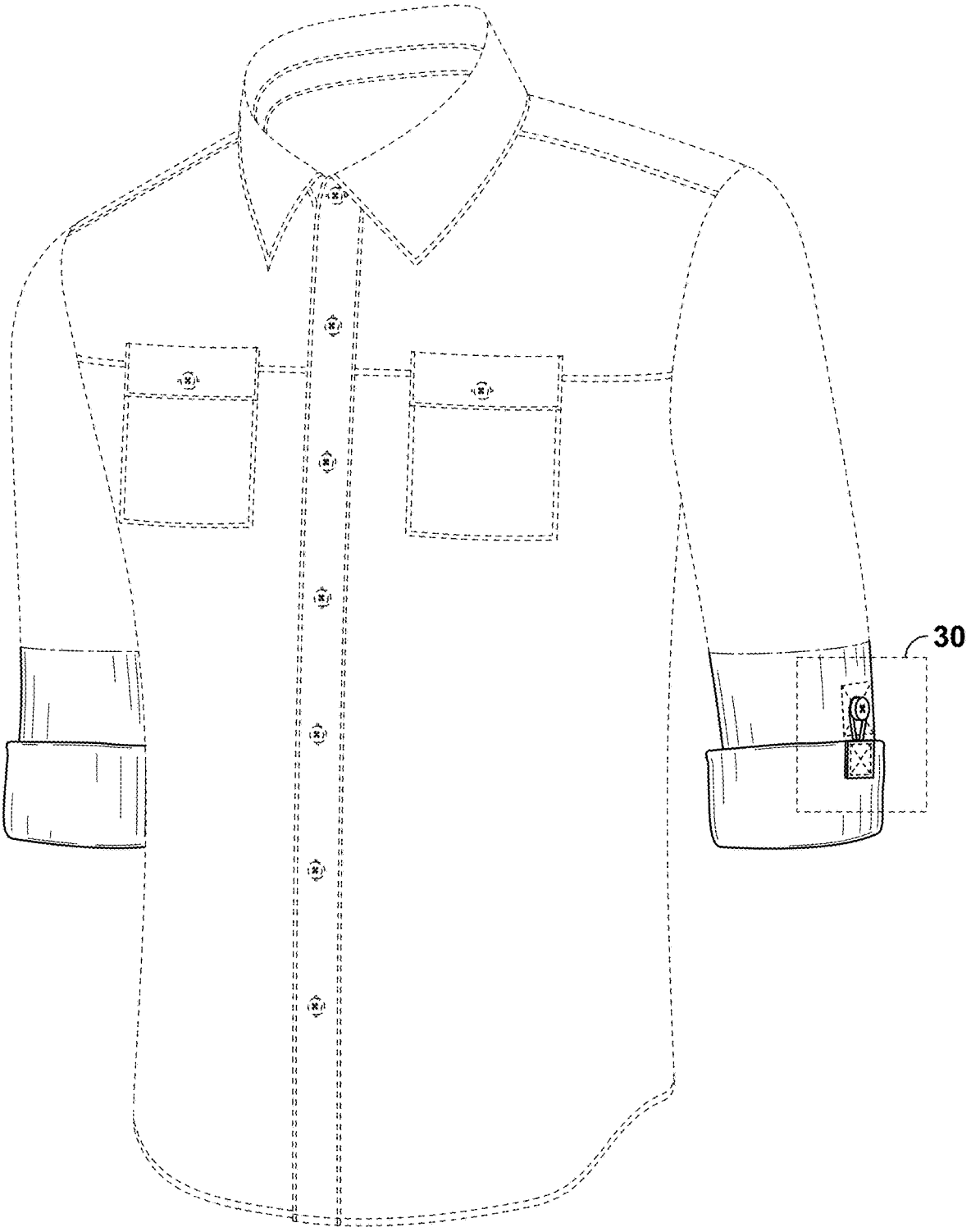
FIG. 26 is a front, right side perspective view of the embodiment of FIG. 16, showing the shirt in a third position, the third position being outside-out with each of the sleeves rolled up and retained in a rolled-up position by the interaction of the button and the tab loop.
Figure 27:
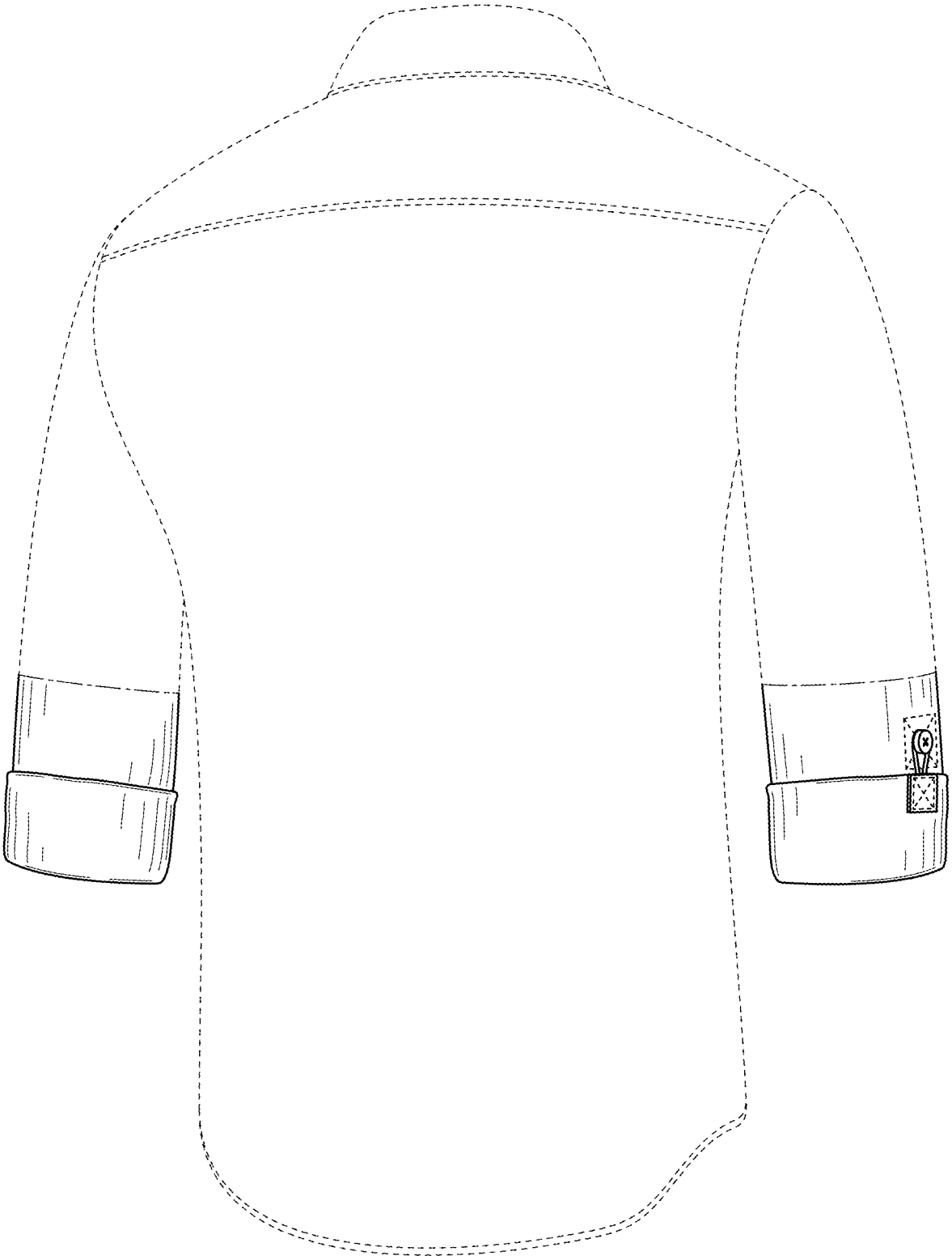
FIG. 27 is a rear, left side perspective view of the embodiment of FIG. 16, showing the shirt in a third position, the third position being outside-out with each of the sleeves rolled up and retained in a rolled-up position by the interaction of the button and the tab loop.
Figure 28:
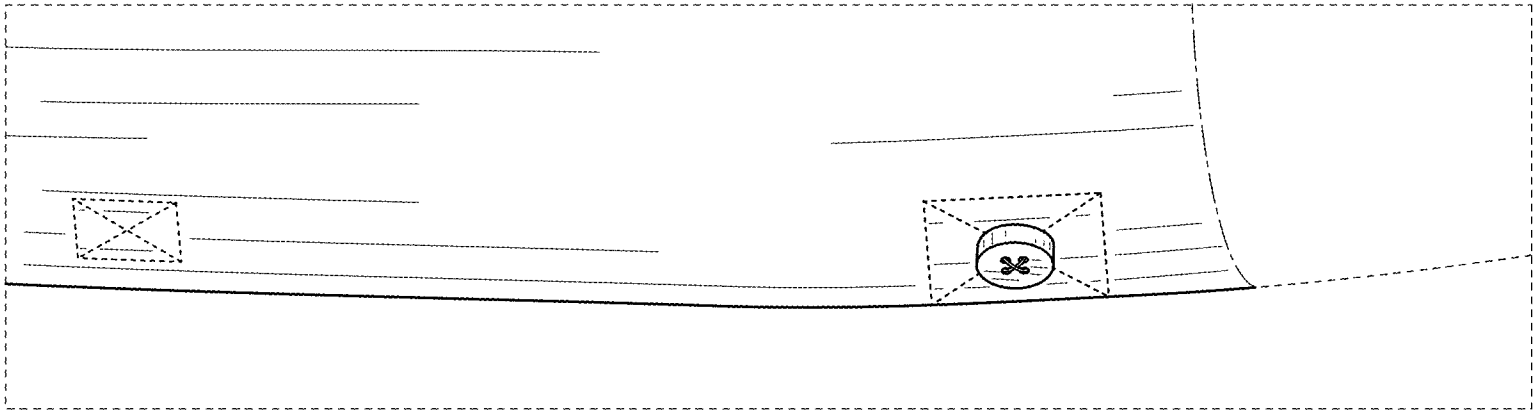
FIG. 28 is a zoomed-in view of a sleeve portion of FIG. 16, showing the button on the exterior of the sleeve.
Figure 29:
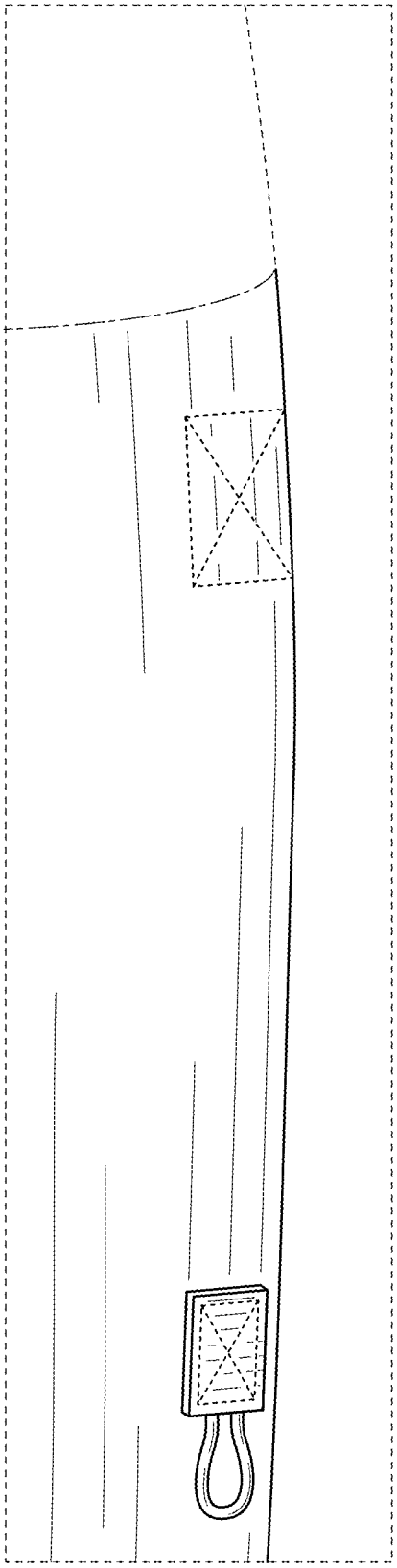
FIG. 29 is a zoomed-in view of a sleeve portion of FIG. 21, showing the tab loop on the interior of the sleeve.
Figure 30:
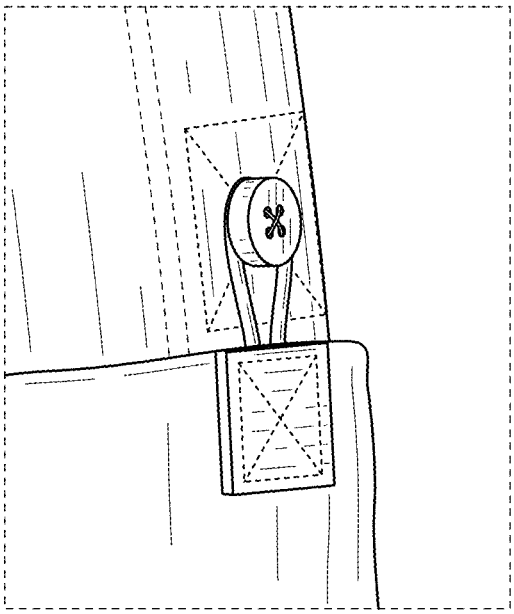
FIG. 30 is a zoomed-in view of a sleeve portion of FIG. 26, showing the interaction between the tab loop and the button when the shirt sleeve portion is in the third position.
Figure 31:
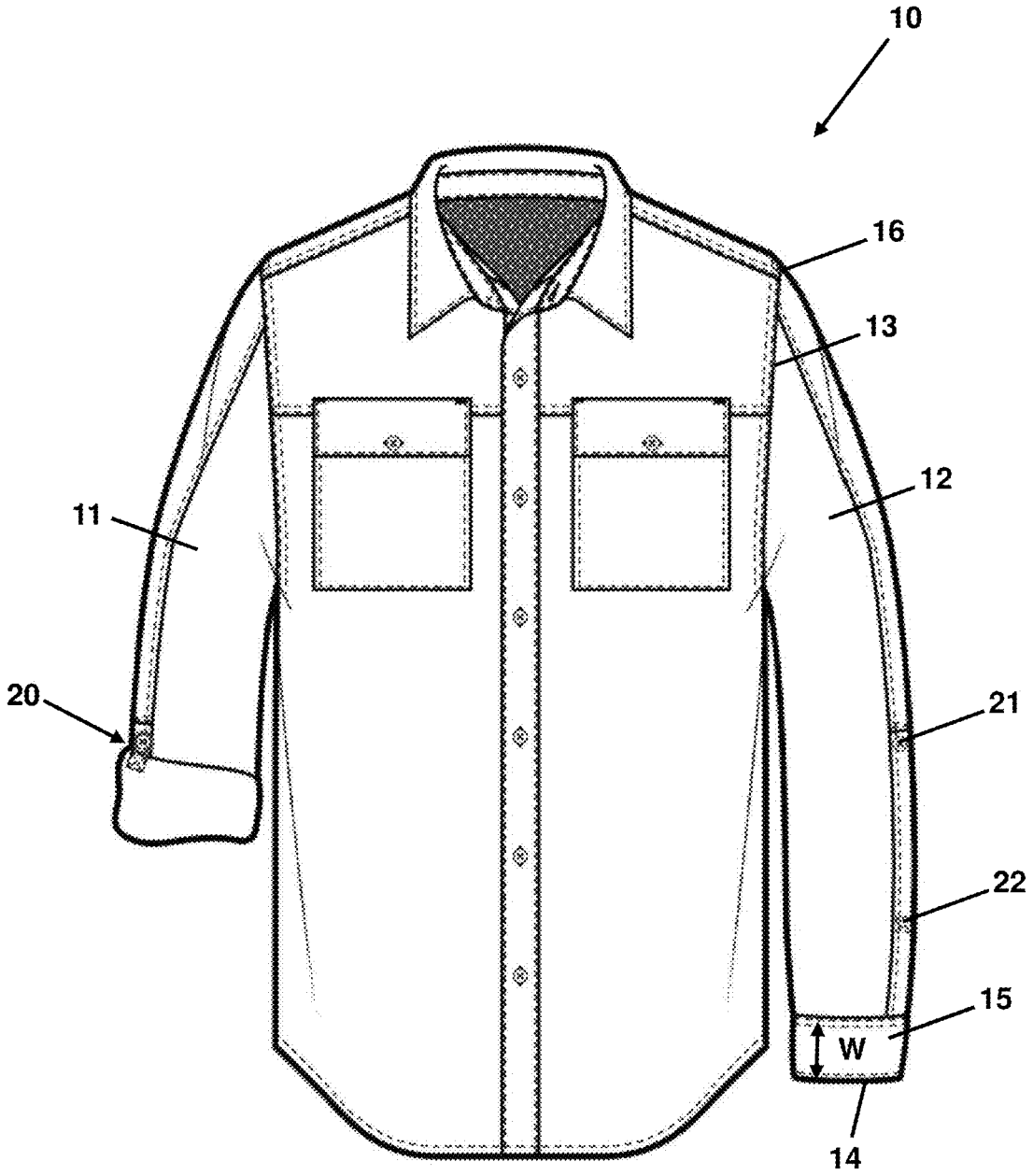
FIG. 31 is a front elevational view of an embodiment of a shirt of the present disclosure.
Figure 32:
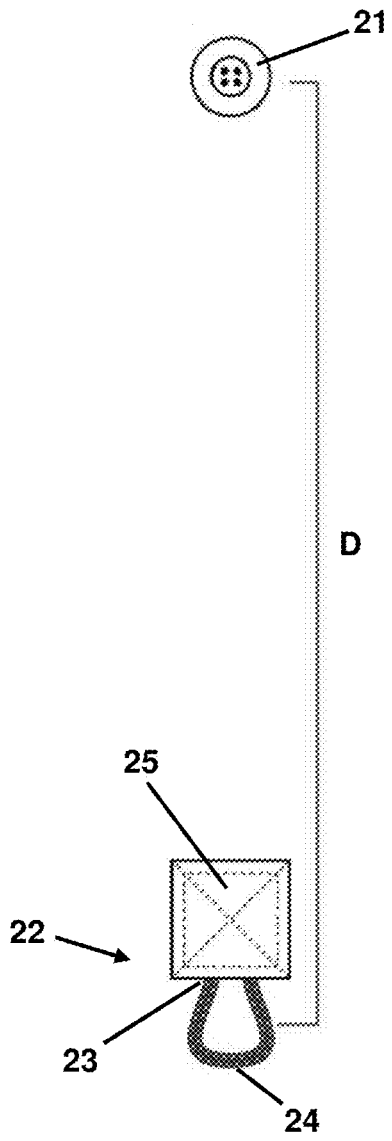
FIG. 32 is a schematic illustrating the distance, D, separating the exterior button and the interior tab loop along the longitudinal axis of the sleeve of an embodiment of the present disclosure.
Figure 33:
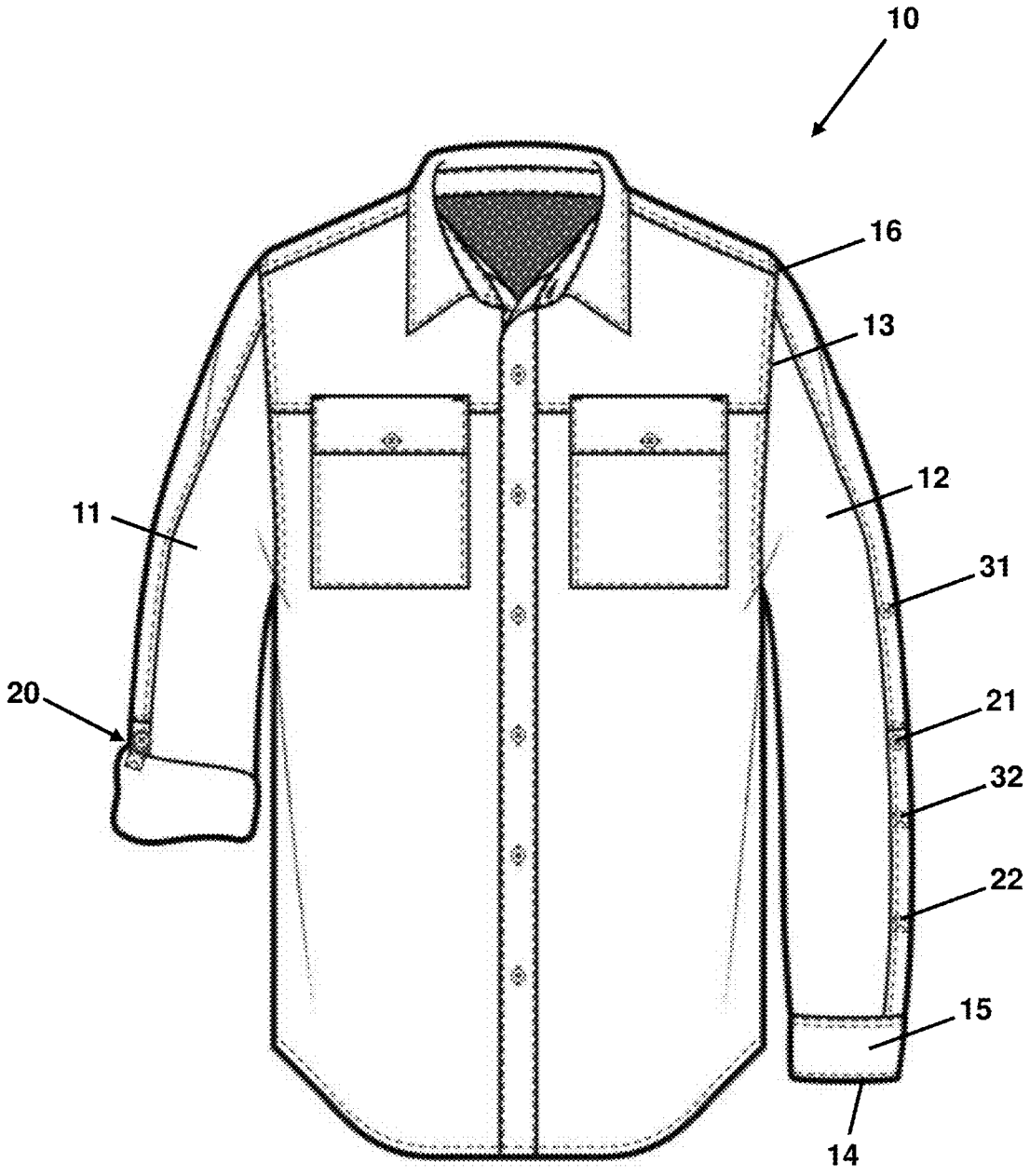
FIG. 33 is a front elevational view of an embodiment of a shirt having first and second exterior buttons and first and second interior tab loops for retaining the sleeves in both a first rolled-up position and a second rolled-up position.

In some embodiments, such as that illustrated in FIG. 18, at least one of the first and second sleeves 11, 12, and more generally each of the first and second sleeves, may further include a second button 31 affixed to the exterior surface of the sleeve and a second tab loop 32 affixed to the interior surface of the sleeve. The second tab loop 32 may be securable to the second button 31 in the same manner that the first tab loop 22 is securable to the first button 21. The inclusion of a second button 31 and second tab loop 32 provides a wearer with multiple options for retaining the sleeve 11, 12 in a rolled-up position. In this way, a shirt 10 may be configured for a user to roll the sleeve to a first rolled-up position, at which point the first tab loop 22 may be secured to the first button 21, or to roll the sleeve to a second rolled-up position—e.g. further up the arm—at which point the second tab loop 32 may be secured to the second button 31. In some embodiments, for instance, the first button 21 may be positioned so as to retain the sleeve in a position that will fall slightly below the elbow of most wearers and the second button 31 may be positioned so as to retain the sleeve in a position that will fall slightly above the elbow of most wearers.

The second button 31 may be positioned a defined distance proximally from the first button 21. For instance, in some embodiments in which the sleeve 11, 12 contains a cuff 15, the second button 31 may be located about one cuff width, W, from the first button 21. For example, the second button 31 may be positioned between 2 and 4 inches proximally from the first button 21. In another embodiment, the second button 31 may be located about two cuff widths, W, from the first button 21. For example, the second button 31 may be positioned between 5 and 7 inches proximally from the first button 21.

Similarly, the second tab loop 32 may be positioned a defined distance proximally from the first tab loop 22. For instance, in some embodiments in which the sleeve 11, 12 contains a cuff 15, the second tab loop 32 may be located about one cuff width, W, from the first tab loop 22. For example, the second tab loop 32 may be positioned between 2 and 4 inches proximally from the first tab loop 22. In another embodiment, the second tab loop 32 may be located about two cuff widths, W, from the first tab loop 22. For example, the second tab loop 32 may be positioned between 5 and 7 inches proximally from the first tab loop 22. In this embodiment, the same patch of fabric used to secure the first button 21 to the sleeve 11, 12 may also serve as patch 25 for attaching the second tab loop 32 to the sleeve.

Accordingly, in some embodiments, after reaching the first rolled-up position, the distal end of the sleeve 14 may be folded outward toward the proximal end of the sleeve 13 one additional time in order to position the second tab loop 32 substantially adjacent to the second button 31 and bring the sleeve into a second rolled-up position. In other embodiments, after reaching the first rolled-up position, the distal end of the sleeve 14 may be folded outward toward the proximal end of the sleeve 13 two additional times in order to position the second tab loop 32 substantially adjacent to the second button 31 and bring the sleeve into a second rolled-up position.

Although the present disclosure has been described in relation to a sleeve retention mechanism 20 for inclusion on the sleeves 11, 12 of a shirt 10, it is understood that embodiments of the sleeve retention mechanism 20 described herein could also be used on the legs of a pant garment. Accordingly, some (non-illustrated) embodiments of the present invention are directed to the use of a sleeve retention mechanism 20, as described herein, on the first and second legs of a pant. It is noted that the term pant should be interpreted broadly to include any garment designed to cover the legs or a portion of the legs (e.g. a short-pant or short; a cropped pant or Capri pant; etc.) of a wearer. By using a sleeve retention mechanism 20 on the legs of a pant, the pant may provide the wearer with a system by which the legs of the pant may be retained in a rolled-up position. Accordingly, a long pant may be rolled-up and retained in a position akin to a short pant, e.g., just above or just below the knee, or a cropped pant. Or the specific length of a short pant (or cropped pant) may be determined by the wearer by rolling the end of the short pant to one of multiple lengths and then using a sleeve retention mechanism 20 as described herein to retain the short pant at the selected length.

It can be seen that the described embodiments provide a unique and novel garment having a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A shirt comprising a first sleeve and a second sleeve, each of the first sleeve and the second sleeve having a proximal end and a distal end, and each of the first sleeve and the second sleeve including a sleeve retention mechanism comprising:

(a) a button affixed to an exterior surface of the respective sleeve when the respective sleeve is in an unrolled position; and (b) a tab loop affixed to an interior surface of the respective sleeve, the tab loop having an exposed portion, the exposed portion unattached to the interior surface of the respective sleeve;

wherein the shirt is configured so that, when the distal end of the respective sleeve is folded outward toward the proximal end of the respective sleeve a predetermined number of times to bring the respective sleeve into a rolled-up position, the tab loop is positioned substantially adjacent to the button; and the tab loop is securable to the button to retain the respective sleeve in the rolled-up position.

2. The shirt of claim 1, wherein the tab loop has a fixed end and a free end and the distance between the fixed end and the free end is less than 3 inches.

3. The shirt of claim 2, wherein the distance between the fixed end and the free end is less than 2 inches.

4. The shirt of claim 1, wherein the tab loop is elastic.

5. The shirt of claim 1, wherein each of the first sleeve and the second sleeve further comprises a cuff having a width, and wherein each time the distal end of the respective sleeve is folded toward the proximal end of the respective sleeve, the respective sleeve is shortened by a distance that substantially corresponds with the width of the cuff.

6. The shirt of claim 5, wherein the predetermined number of times is selected from the group consisting of two, three, and four.

7. The shirt of claim 5, wherein the predetermined number of times is three.

8. The shirt of claim 1, wherein the tab loop is located between 4 and 8 inches distally from the button.

9. The shirt of claim 8, wherein the tab loop is located between 5 inches and 7 inches distally from the button.

10. The shirt of claim 1, wherein the tab loop has a fixed end and a free end and the distance between the fixed end and the free end is less than 3 inches;

wherein each of the first sleeve and the second sleeve comprises a cuff having a width between 2 inches and 3 inches; and wherein the tab loop is located between 5 and 7 inches below the button.

11. The shirt of claim 1, each of the first sleeve and the second sleeve further comprising:

(c) a second button affixed to the exterior surface of the respective sleeve when the respective sleeve is in the unrolled position proximally from the button; and (d) a second tab loop affixed to the interior surface of the respective sleeve proximally from the tab loop;

wherein the second tab loop is securable to the second button to retain the respective sleeve in a second rolled-up position.

12. The shirt of claim 11, wherein the shirt is configured so that, when the distal end of the respective sleeve is folded outward toward the proximal end of the respective sleeve a predetermined number of times to bring the respective sleeve into the second rolled-up position, the tab loop is positioned substantially adjacent to the second button.

13. The shirt of claim 12, wherein the second button is located between 2 and 4 inches proximally from the button.

14. The shirt of claim 11, wherein the second button is positioned about 12 inches from the proximal end of the respective sleeve and the button is positioned about 15 inches from the proximal end of the respective sleeve.

15. A shirt comprising a first sleeve and a second sleeve, each of the first sleeve and the second sleeve having a proximal end and a distal end, and each of the first sleeve and the second sleeve including a sleeve retention mechanism comprising:

(a) a button affixed to an exterior surface of the respective sleeve when the respective sleeve is in an unrolled position; and (b) a tab loop affixed to an interior surface of the respective sleeve;

wherein the tab loop is located between 4 and 8 inches distally from the button;

wherein the tab loop has a fixed end attached to the interior surface of the respective sleeve and a free end unattached to the interior surface of the respective sleeve, and the distance between the fixed end and the free end is less than 3 inches; and wherein the tab loop is securable to the button when the respective sleeve is in a rolled up position in order to retain the respective sleeve in the rolled up position.

16. The shirt of claim 15, wherein the tab loop is located between 5 and 7 inches distally from the button.

17. The shirt of claim 16, wherein the distance between the fixed end and the free end of the tab loop is less than 2 inches.

18. The shirt of claim 17, each of the first sleeve and the second sleeve further comprising a cuff having a width between 2 inches and 3 inches.

19. The shirt of claim 15, each of the first sleeve and the second sleeve further comprising (c) a second button affixed to the exterior surface of the respective sleeve when the respective sleeve is in the unrolled position proximally from the button; and (d) a second tab loop affixed to the interior surface of the respective sleeve proximally from the tab loop;

wherein the second tab loop is securable to the second button when the respective sleeve is in a second rolled up position in order to retain the respective sleeve in the second rolled-up position.

20. The shirt of claim 19, wherein the second button is located between 2 inches and 4 inches proximally from the button.

21. The shirt of claim 15, wherein the sleeve retention mechanism further comprises a patch, the patch secured to the interior surface of the respective sleeve to secure the fixed end of the tab loop to the interior surface of the respective sleeve.

* * * * *